US008306447B2

(12) United States Patent
Ogura

(10) Patent No.: US 8,306,447 B2
(45) Date of Patent: Nov. 6, 2012

(54) POTENTIAL SENSOR, ELECTROPHOTOGRAPHIC IMAGE FORMING APPARATUS INCLUDING THE POTENTIAL SENSOR, AND MANUFACTURING METHOD OF POTENTIAL SENSOR

(75) Inventor: Motohiro Ogura, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 555 days.

(21) Appl. No.: 12/546,214

(22) Filed: Aug. 24, 2009

(65) Prior Publication Data

US 2010/0054773 A1 Mar. 4, 2010

(30) Foreign Application Priority Data

Sep. 3, 2008 (JP) ..... 2008-225396

(51) Int. Cl.
*G03G 15/00* (2006.01)

(52) U.S. Cl. ..... 399/73; 399/48; 702/64

(58) Field of Classification Search ..... 399/48, 399/73; 427/117, 118; 702/64
See application file for complete search history.

(56) References Cited

U.S. PATENT DOCUMENTS

| | | | | |
|---|---|---|---|---|
| 2,892,973 | A * | 6/1959 | Straughan | 361/225 |
| 4,261,660 | A * | 4/1981 | Suzuki et al. | 399/48 |
| 5,633,700 | A * | 5/1997 | Peck et al. | 399/73 |
| 5,983,043 | A * | 11/1999 | Ohwaki et al. | 399/48 |

FOREIGN PATENT DOCUMENTS

| | | |
|---|---|---|
| EP | 0 926 570 | 6/1999 |
| JP | 11-183542 | 11/1999 |
| JP | 2002-040876 | 2/2002 |
| JP | 2004-077125 | 3/2004 |

* cited by examiner

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

A potential sensor for detecting a surface potential of an electrophotographic photosensitive member includes an insulative film; a thin film electrode layer formed on the film; a curved portion formed by folding back the film so that the thin film electrode layer is inwardly located, the curved potion functioning as a detecting portion for detecting the surface potential of the electrophotographic photosensitive member in contact with the electrophotographic photosensitive member; and an electroconductive shielding portion provided so as to cover an outer surface of the film except for at least an area in which the curved portion is contactable to the electrophotographic photosensitive member, the shielding portion being electrically grounded.

19 Claims, 19 Drawing Sheets

POTENTIAL SENSOR, ELECTROPHOTOGRAPHIC IMAGE FORMING APPARATUS INCLUDING THE POTENTIAL SENSOR, AND MANUFACTURING METHOD OF POTENTIAL SENSOR

FIELD OF THE INVENTION AND RELATED ART

The present invention relates to a potential sensor (an electric-potential sensor), an electrophotographic image forming apparatus including the potential sensor, and a manufacturing method of the potential sensor. As the image forming apparatus, it is possible to use apparatuses for forming an image through electrophotography, such as a copying machine, a printer, a facsimile machine, a multi-function machine having a plurality of functions of these machines, and the like.

In the electrophotographic image forming apparatus, a toner image is formed through a series of steps of electric charging, light exposure, development, and transfer. In order to realize high image quality in the apparatus, it is important to electrically charge a surface of a photosensitive member uniformly by a charger in an electrically charging step.

For that reason, a technique in which a surface potential of the photosensitive member electrically charged by the charger is detected and a charging condition by the charger is corrected so that the surface potential is a proper value has been conventionally employed. Further, a technique in which the photosensitive member is idled for a predetermined time in the case where a judgment is made that a desired electrophotographic image is not formed (i.e., when an electrophotographic image on the photosensitive member is disturbed due to ambient moisture) based on a result of the detection of the surface potential of the photosensitive member has also been proposed.

For example, in an apparatus described in Japanese Laid-Open Patent Application (JP-A) Hei 11-183542, a potential sensor includes an elongated curved electrode of which surface is opposed to the photosensitive member with a gap of 10 to 100 μm at an opposing portion and an electrophotographic image on the photosensitive member passing through the opposing portion is by the potential sensor with a dot-size resolution. The potential sensor detects potential distribution of a predetermined electrophotographic image formed on the photosensitive member so that the electrophotographic image has a predetermined line width and is parallel to the electrode surface and then outputs an output voltage corresponding to a differential waveform of the electrophotographic image potential distribution.

In this case, the potential sensor is disposed in non-contact with the photosensitive member, so that when the photosensitive member causes eccentricity (off-center), the gap between the potential sensor and the photosensitive member fluctuates. As a result, it is difficult to detect the surface potential of the photosensitive member with high accuracy.

In an apparatus described in JP-A 2004-77125, a potential sensor for detecting a surface potential (surface defect) of a photosensitive member with a dot-size resolution in a state in which an outer surface of an insulative film which covers a periphery of a curved surface of a wire electrode is brought into contact with the photosensitive member is used.

In this case, the potential sensor is disposed in contact with the photosensitive member, so that it is possible to detect the surface potential of the photosensitive member with high accuracy.

However, a signal to noise (S/N) ratio of an output signal of the potential sensor has been largely lowered in some cases by radiation noise from the image forming equipment (e.g., a developing device or a charger) disposed in the neighborhood of the potential sensor.

In these cases, the output signal is influenced by the radiation noise which largely fluctuates, so that accuracy of detection of the surface of the photosensitive member is lowered. As a result, optimization of the surface potential of the photosensitive member with high accuracy on the basis of the output of the potential sensor cannot be realized.

SUMMARY OF THE INVENTION

A principal object of the present invention is to provide a potential sensor capable of improving potential detection accuracy.

Another object of the present invention is to provide an image forming apparatus including the potential sensor and a manufacturing method of the potential sensor.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described with reference to the drawings. The present invention can also be carried out in other embodiments in which a part or all of constitutions of the following embodiments are replaced by alternative constitutions so long as at least one surface of a potential sensor except for an end of the potential sensor is covered with an electroconductive material.

In the First Embodiment, the present invention can be carried out by an image forming apparatus in which a toner image is directly transferred from a photosensitive drum onto a recording material in a sheet-fed manner. However, the present invention can also be carried out by an image forming apparatus using an intermediary transfer belt and an image forming apparatus using a recording material conveying belt.

Incidentally, general matters regarding the image forming apparatus and the potential sensor which are described in JP-A 2002-40876, JP-A Hei 11-183542, and JP-A 2004-77125 are omitted from illustration, thus being omitted from redundant explanation.

<First Embodiment>

Figure 1:
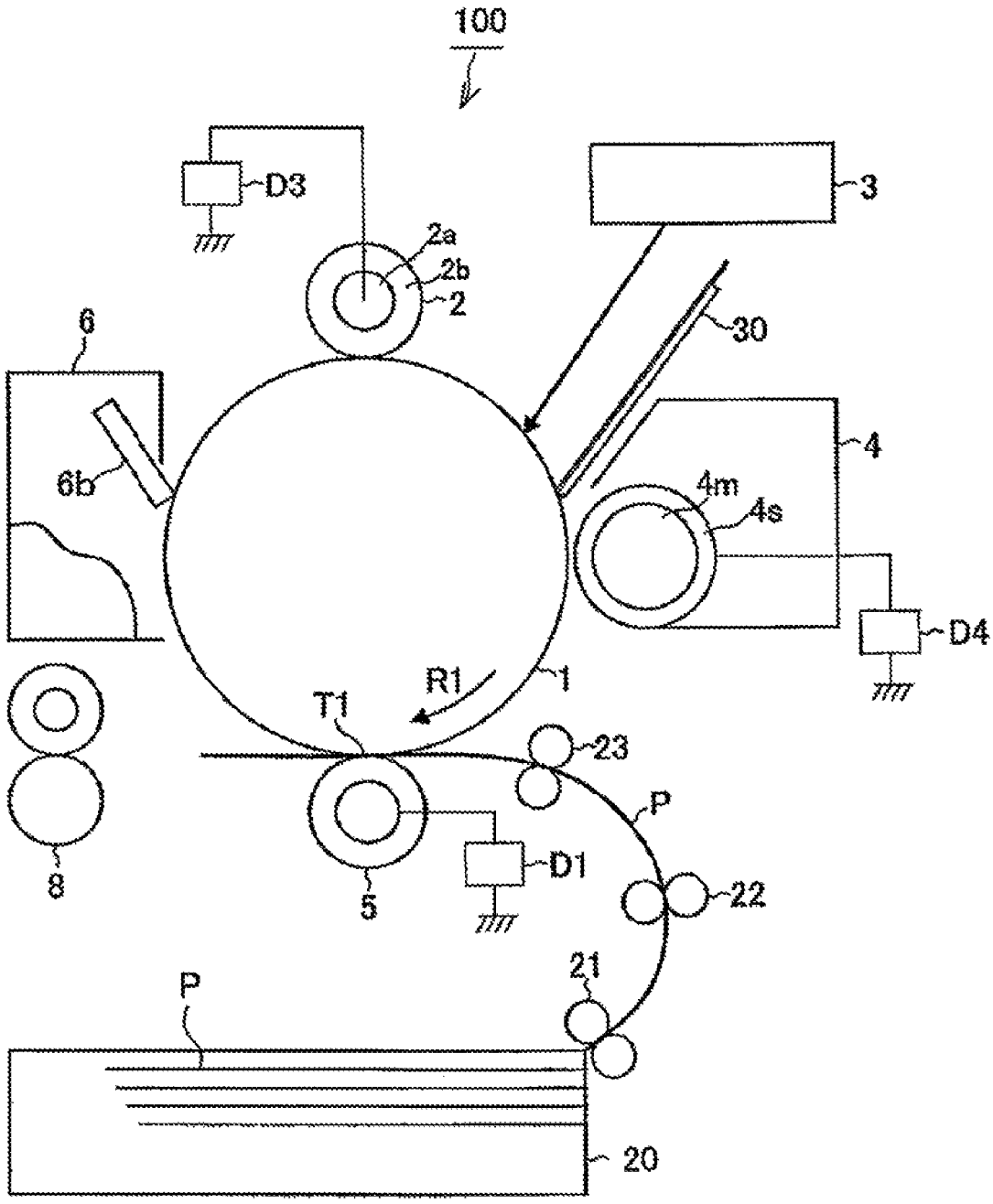
FIG. 1 is an explanatory view of a structure of an image forming apparatus to which a potential sensor is attached.

FIG. 1 is an explanatory view of a structure of an image forming apparatus to which a potential sensor is attached.

Referring to FIG. 1, an image forming apparatus 100 forms a toner image on a photosensitive drum 1 and transfers the toner image onto a recording material (sheet) P at a transfer portion T1. The sheet P on which the toner image is transferred is sent into a fixing device 8, by which the toner image is fixed.

Around the photosensitive drum 1, as an example of a photosensitive member, a charging roller 2, an exposure device 3, a developing device 4, a transfer roller 5, a cleaning device 6, and a potential sensor 30 are disposed.

In this embodiment, the charging roller 2, which is a charging means, comes in contact with the photosensitive drum 1 and is rotated by rotation of the photosensitive drum 1. The charging roller 2 is used in a state in which an oscillating voltage in the form of a DC voltage biased with an AC voltage, which is applied from a power source D3 to the charging roller 2. The charging roller 2 electrically charges the photosensitive drum 1 to a uniform dark portion potential VD of a negative polarity.

As the exposure device 3, which is an exposure means, a semiconductor laser for irradiating the photosensitive drum 1 electrically charged to the dark portion potential VD to a laser beam (wavelength $\lambda$=780 nm) is used. The semiconductor laser is used for scanning exposure of the photosensitive drum 1, so that an electric potential of an exposed portion is lowered to a light portion potential VL to form an electrophotographic image for an image.

The developing device 4, which is an example of a developing means, develops the electrophotographic image formed on the photosensitive drum 1 with negatively charged toner to form a toner image. The developing device 4 carries the toner on a developing sleeve 4*s* rotating about a fixed magnetic pole 4*m* to slide on the photosensitive drum 1. By applying an oscillating voltage in the form of a developing voltage Vdc biased with an AC voltage from a power source D4 to the developing sleeve 4*s*, the toner is transferred onto a potential of the photosensitive drum 1 having the light portion potential VL, so that the electrode is reversely developed.

The transfer roller 5, which is an example of a transfer means, forms the transfer portion T1, in contact with the photosensitive drum 1, where the recording material P is to be nip-conveyed. The negatively charged toner image carried on the photosensitive drum 1 is transferred onto the nip-conveyed recording material P by application of a DC voltage from a power source D1 to the transfer roller 5.

The recording material P is taken out from a cassette 20 and is separated one by one by a separation roller 21. The separated recording material P is conveyed from a conveying roller 22 to a registration roller 23 to be placed in a stand-by state. The registration roller 23 sends the recording material P to the transfer portion T1 with timing synchronized with the toner image carried on the photosensitive drum 1.

The cleaning device 6 removes untransferred residual toner from the surface of the photosensitive drum 1 having passed through the transfer portion T1 by rubbing the photosensitive drum 1 with a cleaning blade 6*b*. The cleaning device 6 evaporates water content deposited on the surface of the photosensitive drum 1 by rubbing the rotating photosensitive drum 1 with the cleaning blade 6*b* during image formation to cause frictional heating. For this reason, when the rotation of the photosensitive drum 1 is continued, a surface resistance of the photosensitive drum 1 is gradually restored with removal of the water content through the rubbing.

The potential sensor 30 is disposed in contact with the photosensitive drum 1 at a position between an exposure position of the exposure device 3 and a developing position of the developing device 4 and detects a predetermined electrophotographic image formed during non-image formation.

<Photosensitive Member>

Figure 2:
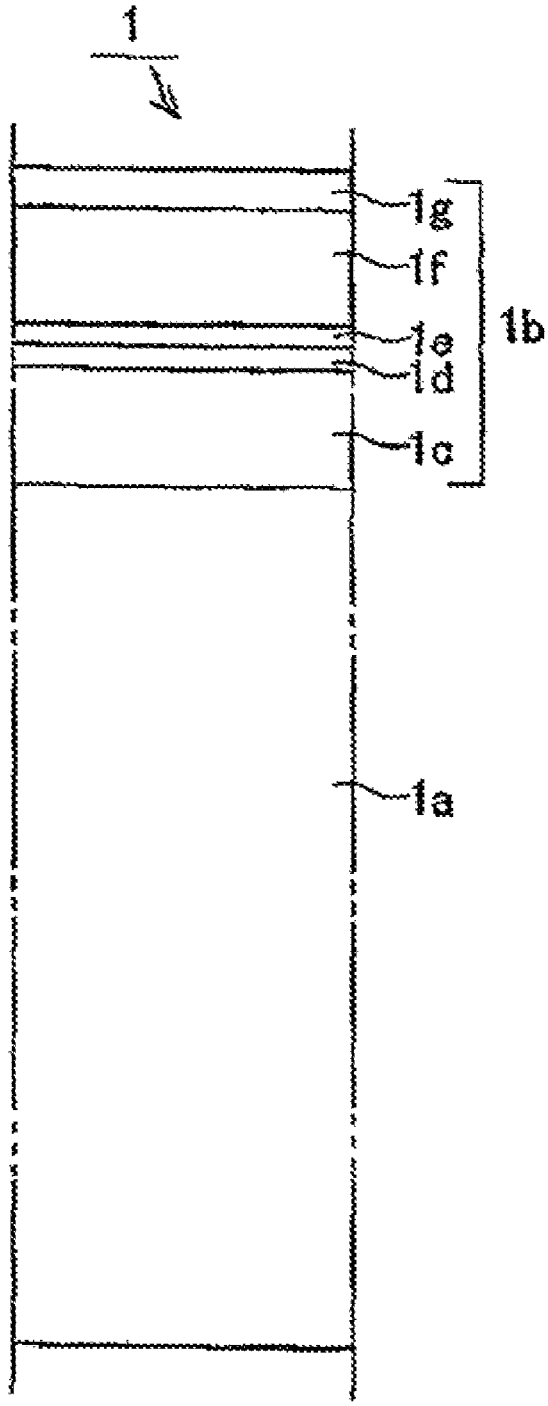
FIG. 2 is an explanatory view of a structure of a photosensitive layer of a photosensitive drum.

FIG. 2 is an explanatory view of a structure of a photosensitive layer of the photosensitive drum 1.

The photosensitive drum 1 is an electrophotographic photosensitive member which includes an electroconductive cylindrical base portion of aluminum and at least a surface layer, of a photosensitive layer disposed on the surface of the base portion, formed of a cured compound by polymerization or cross-linking and is rotatable by a main assembly of the image forming apparatus. Incidentally, as the photosensitive layer, it is also possible to use an amorphous silicon organic optical semiconductor.

As shown in FIG. 2, the photosensitive drum 1 is prepared by forming a photosensitive layer 1*b* consisting of an electroconductive layer 1*c*, an intermediate layer 1*d*, a charge generation layer 1*e*, a charge transport layer 1*f*, and a protective layer 1*g* on the surface of a base layer 1*a* of an aluminum cylinder having a diameter of 30 mm and a length of 360 mm. The photosensitive layer 1*b* of the photosensitive drum 1 is irradiated with an electron beam to enhance surface hardness.

In the case of the photosensitive drum 1 having high hardness, an abrasion speed of the photosensitive layer 1*b* is 1.4 or less of a conventional abrasion speed. For this reason, the photosensitive drum 1, which has conventionally reached the end of a lifetime thereof at the time of image formation on 30,000 to 70,000 sheets of plain paper, can be subjected to continuous image formation until the number of sheets reaches 120,000 to 300,000 sheets.

In another aspect, with respect to the high-hardness photosensitive drum 1, an electric discharge product, which has been removed with surface abrasion, remains on the surface of the photosensitive drum 1 in a larger amount, so that image deletion due to the electric discharge product is more liable to occur.

<Charger>

In this embodiment, a charger of a type using a charging roller is employed, but the present invention is similarly applicable to chargers of other types, such as a corona charger, an injection charger, and the like.

The charging roller 2 is prepared by providing an elastic layer 2*b* of a rubber elastic material on a round bar 2*a* of an electroconductive supporting member (formed of a metal material of iron, copper, stainless steel, aluminum, nickel, or the like). Electroconductivity is imparted to the elastic layer 2*b*. The elastic layer 2*b* may preferably have a thickness in the range of 1-500 mm.

As a method of imparting the electroconductivity to the elastic layer 2*b*, it is possible to employ a method in which an electroconductive agent having an electron conduction mechanism such as carbon black, graphite, or electroconductive metal oxide is added in the rubber elastic material. Further, it is also possible to add an electroconductive agent having an ion conduction mechanism such as an alkali metal salt or a quaternary ammonium salt. By foaming the rubber elastic material to which the electroconductivity is imparted, the elastic layer 2*b* may preferably be adjusted to have an electric resistance of less than $1\times10^{1}$ Ω×cm.

As a specific elastic material for the elastic layer 2*b*, it is possible to use natural rubber and synthetic rubbers such as ethylene-propylene-diene-methylene (EPDM), styrene-butadiene rubber (SBR), silicone rubber, urethane rubber, epichlorohydrin rubber, isoprene rubber (IR), butadiene rubber (BR), nitrile-butadiene rubber (NBR), and chloroprene rubber (CR); and resin materials, such as polyamide resin, polyurethane resin, and silicone resin.

The charging roller 2 is formed in an outer diameter of 16 mm and when the oscillating voltage is applied from the power source D3 to the charging roller 2, the surface of the photosensitive drum 1 is electrically charged to a predetermined potential by the charging roller 2. As the voltage to be applied to the charging roller 2, the oscillating voltage in the form of the DC voltage biased with the AC voltage may preferably be used. The oscillating voltage referred to herein is a voltage having a voltage value periodically changing with time and the AC voltage may desirably have a peak-to-peak voltage which is two times or move an electric discharge start voltage at the time when only the DC voltage is applied to the charging roller 2. As a waveform of the AC voltage, it is possible to use not only a sine wave but also a rectangular wave, a triangular wave, and a pulse wave. However, from the viewpoint of a lowering in charging noise, the sine wave containing no harmonic component may preferably be used.

The power source (charging bias application means) D3 effects constant voltage control such that an AC voltage is output at a frequency of 1.8 kHz to provide a total current of 2000 μA. The DC voltage to be biased with the AC voltage is set at a constant charging target voltage (the dark portion potential=700 V). That is, the DC voltage VD applied to the charging roller 2 is transferred onto the surface of the photosensitive drum 1 with the electric discharge with respect to both directions by the AC voltage.

<Developing Device>

In this embodiment, as the developing means for developing the electrophotographic image formed on the photosensitive drum 1, a developing device using a one component developing system is employed.

The developing sleeve 4*s* and the photosensitive drum 1 are disposed so as to keep a constant gap of 0.3 mm along a longitudinal direction of the photosensitive drum 1. As the toner, negatively chargeable one component magnetic toner is used and is subjected to jumping reverse development by application of a rectangular waveform-oscillating voltage to the developing sleeve 4*s*.

To the developing sleeve 4*s*, from the power source D4, the oscillating voltage in the form of a negative DC voltage (Vdc=−350 V) biased with an AC voltage (peak-to-peak voltage Vpp=1.2 kV) is applied. The magnetic toner carried on the surface of the developing sleeve 4*s* is conveyed to the developing position, where the toner is urged by the DC voltage Vdc to be transferred from the developing sleeve 4*s* onto the electrophotographic image on the photosensitive drum 1 in a process of reciprocation between the photosensitive drum 1 and the developing sleeve 4*s* in response to the AC voltage.

Incidentally, the oscillating voltage referred to herein is a voltage having a voltage value which periodically changes with time. As the waveform of the AC voltage, it is possible to use not only a rectangular wave but also a sine wave, a triangular wave, and a pulse wave. However, from the view point of cost advances and shape factor, the rectangular wave may preferably be employed.

<Potential Sensor>

Figure 3:
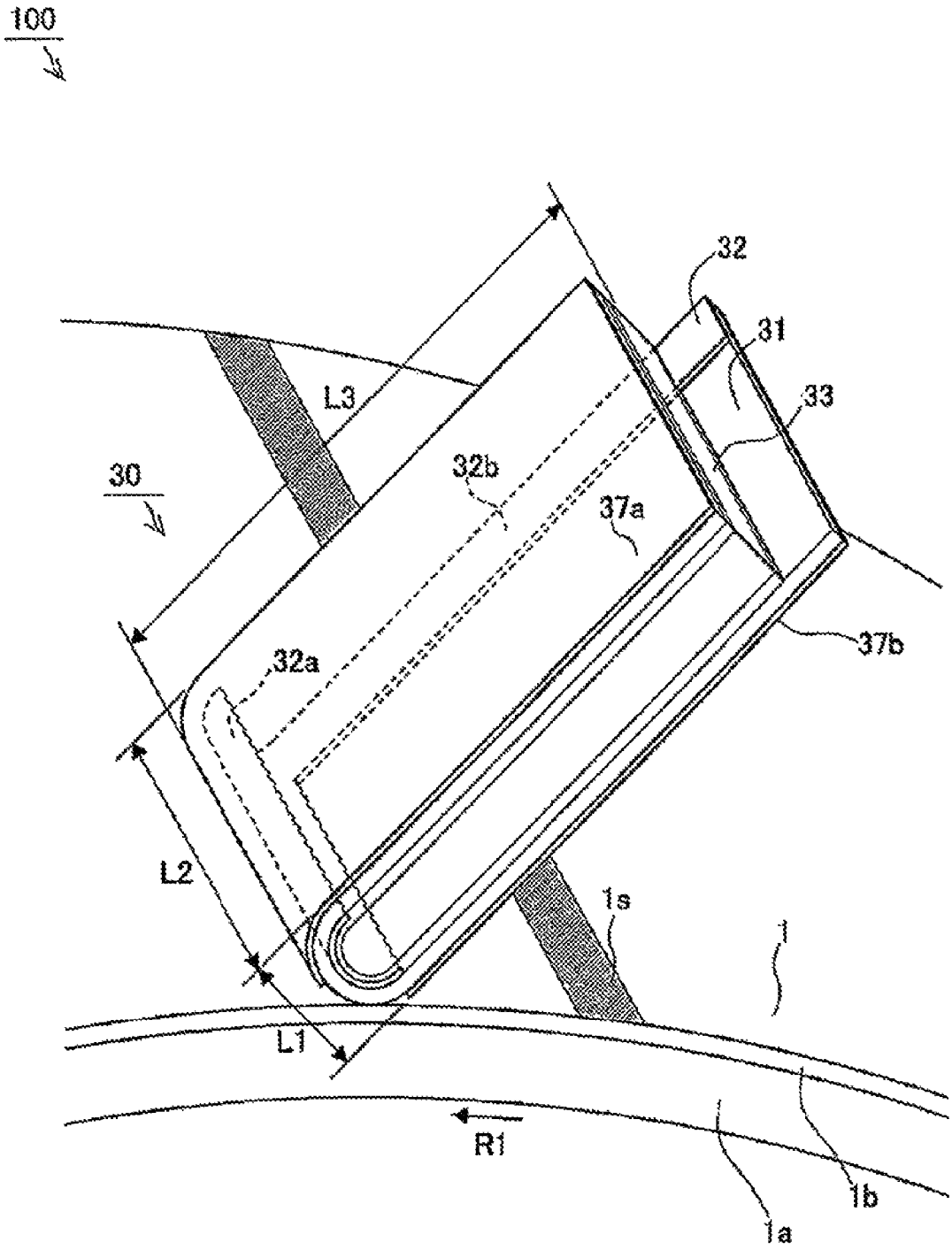
FIG. 3 is an explanatory view of a structure of the potential sensor.
Figure 4:
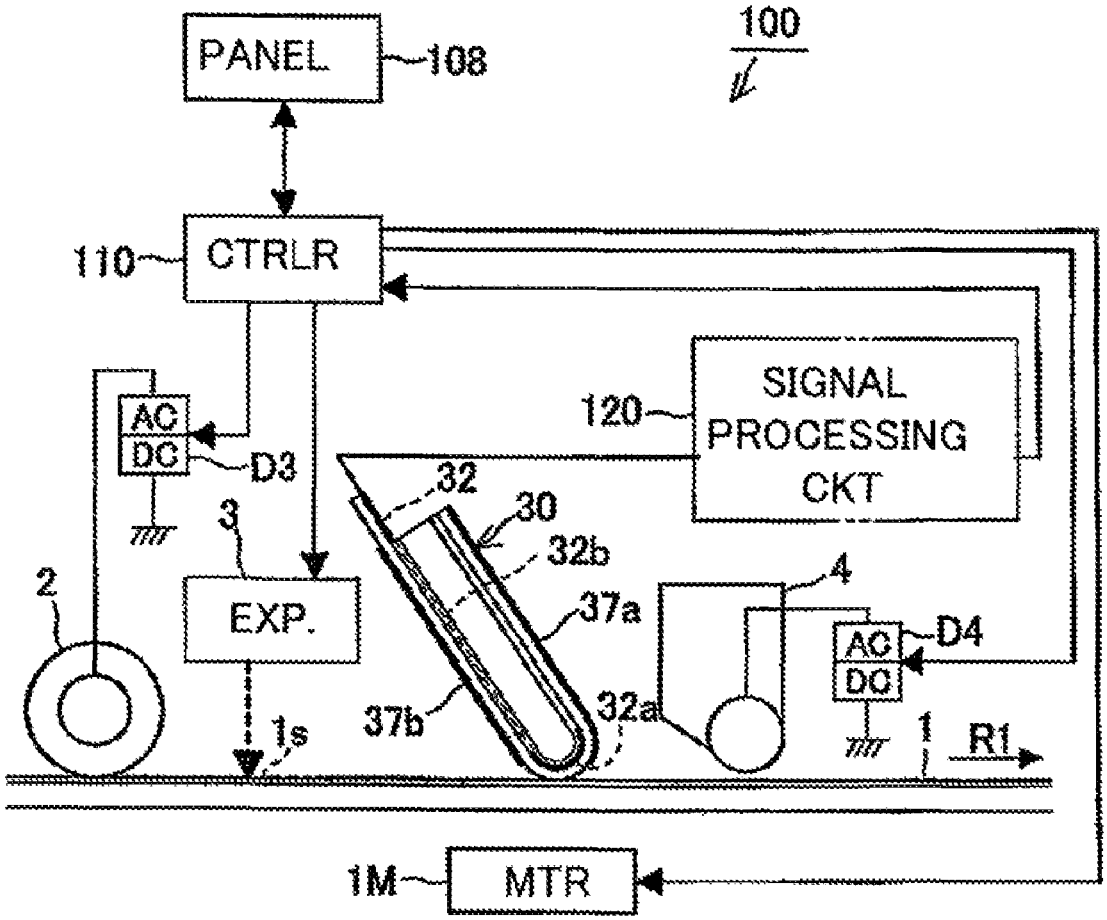
FIG. 4 is an explanatory view of an output circuit of the potential sensor.
Figure 17:
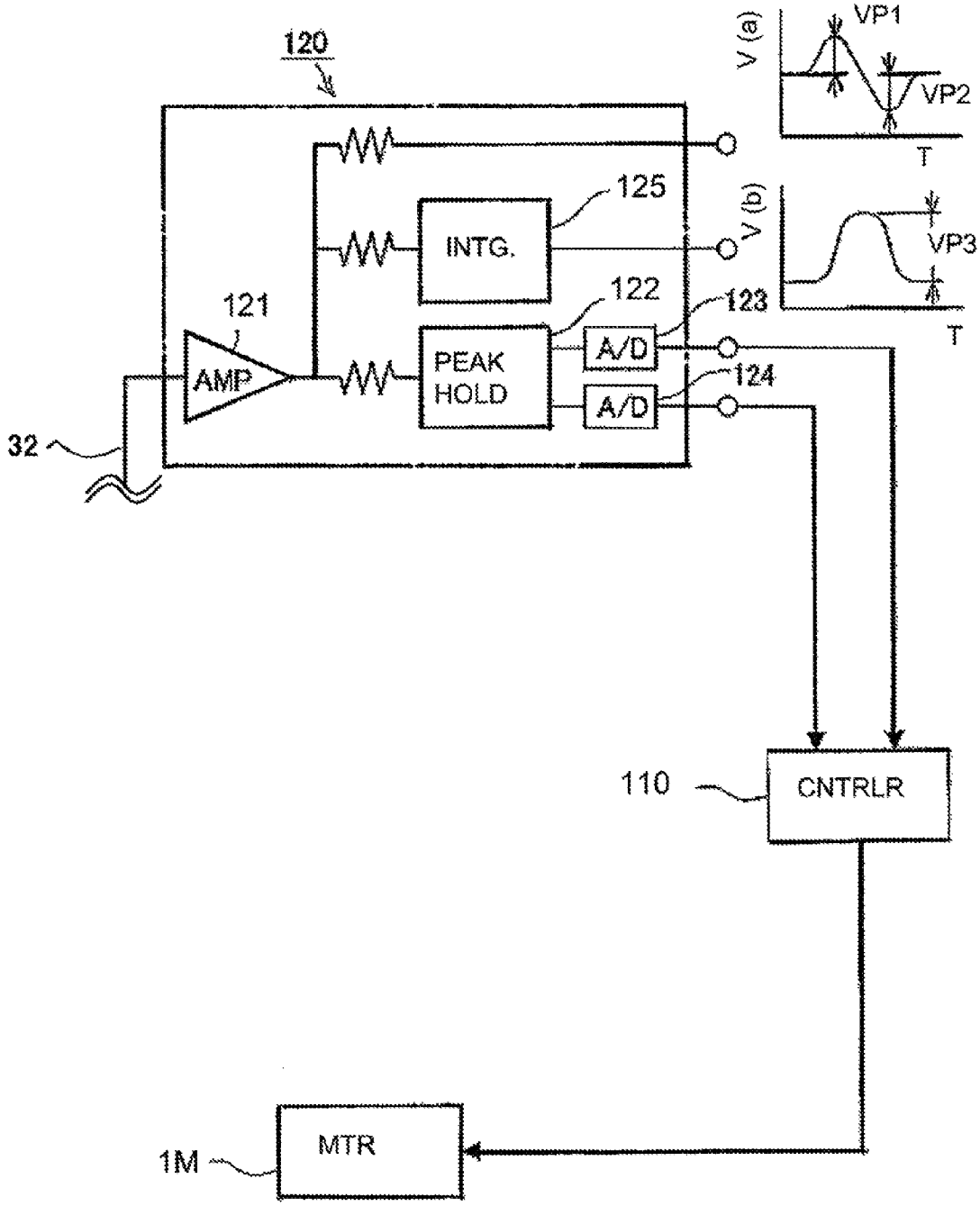
FIG. 17 is an explanatory view of a signal processing portion.

FIG. 3 is an explanatory view of a potential sensor and FIG. 4 and FIG. 17 are explanatory views of an output circuit of the potential sensor.

As shown in FIG. 3 with reference to FIG. 1, the potential sensor 30 is formed in a thin plate shape such that a thickness L1 of a folded resin film is 100 μm, a width L2 of the film is 2.5 mm, and a length L3 of the film is 20 mm and contacts the photosensitive drum 1 at a curved end surface in which an electrode member is embedded.

The potential sensor 30 is caused to slide on the photosensitive drum 1 by being obliquely inclined at a thin plate-like side surface portion so that the potential sensor 30 is supported in a cantilever-like manner by a main assembly of the image forming apparatus so as to project in a rotational direction R1 of the photosensitive drum 1 at the curved end surface. The potential sensor 30 contacts the photosensitive drum 1 at the thin plate-like curved surface portion, so that a contact pressure thereof with respect to the photosensitive drum 1 is set by a bending reaction force of the thin plate-like side surface portion inclined at a predetermined inclination angle. The potential sensor 30 contacts the photosensitive drum 1 at the outer side surface of an insulative film layer, having a thickness of 25 μm, covering the surface of the electrode, so that an opposing distance between the electrode surface and the photosensitive drum 1 surface is set at 25 μm.

A contact line, along which the potential sensor 30 contacts the photosensitive drum 1, is positioned parallel to a rectilinear line crossing the surface of the photosensitive drum 1 in an axial direction (generating line of the curved surface). For this reason, an electrophotographic image 1*s* formed on the photosensitive drum 1 with respect to a main scan direction passes through the contact line substantially at one time.

The insulative film 31 of the potential sensor 30 is folded with a predetermined curvature so as to form the curved surface contactable to the photosensitive drum 1. A thin film electrode layer 32 is formed in a thin film pattern to constitute a detection electrode portion 32*a*, at the curved surface, adhesively contacting the inner side surface of the film 31 in a folding area. A center layer 33 is provided so that mutually opposing detection electrode portions do not contact each other during the folding, i.e., cause no electrical short circuit. That is, the center layer 33 is an insulative cover layer laminated on the thin film electrode layer 32 provided on the film 31 so as to cover the thin film electrode layer 32. The thin film electrode layer 32 includes a connecting wiring portion 32*b* fixed to the inner surface of the film 31 while being extended continuously from the detection electrode portion 32*a* so that the thin film electrode layer 32 is electrically connectable with a signal processing portion 120 on a side opposite from the folding area of the film 31.

<Insulative Film, Electrode Pattern)

Figure 9:
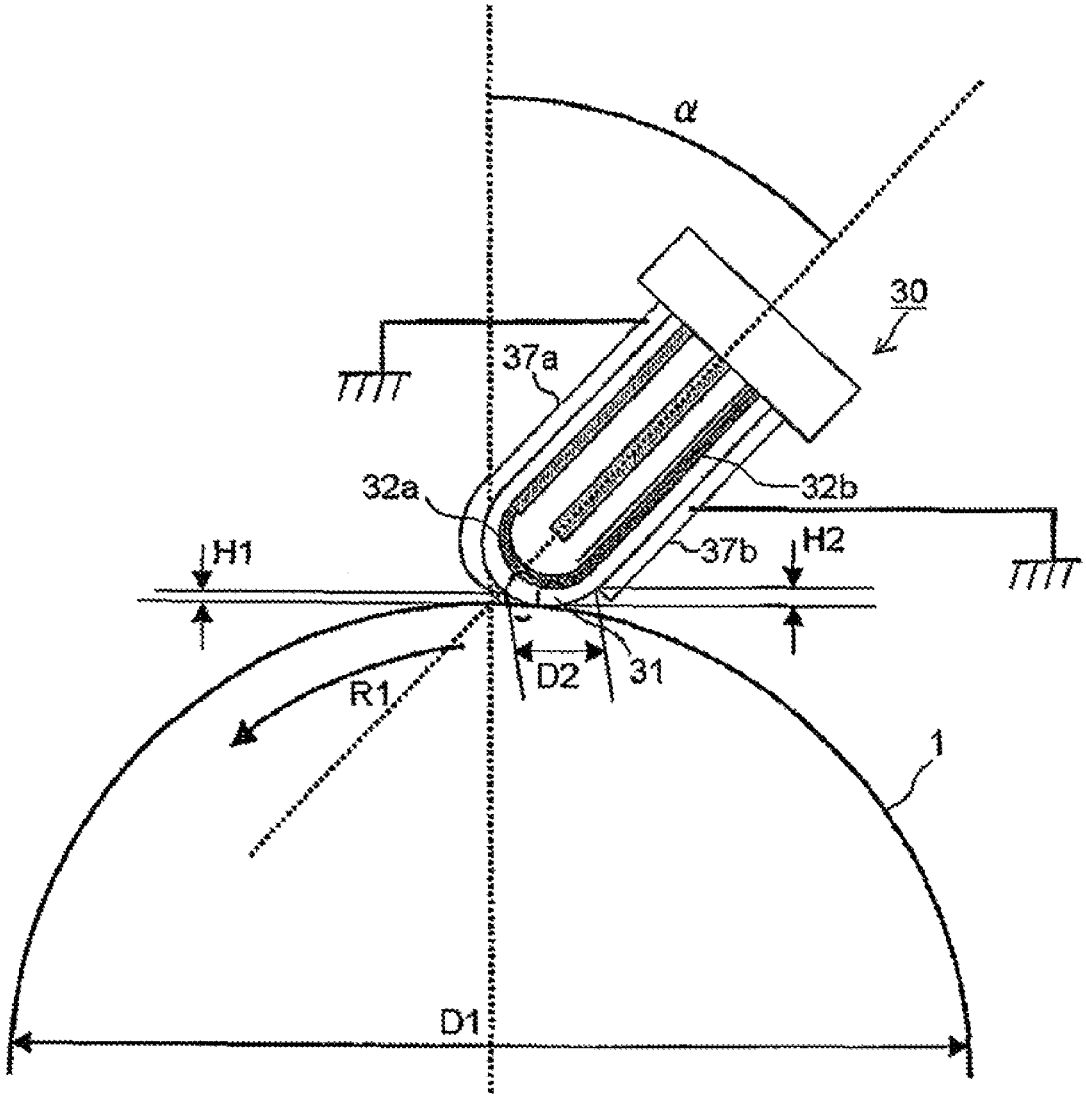
FIG. 9 is an explanatory view of a cross-sectional structure of the potential sensor.
Figure 10:
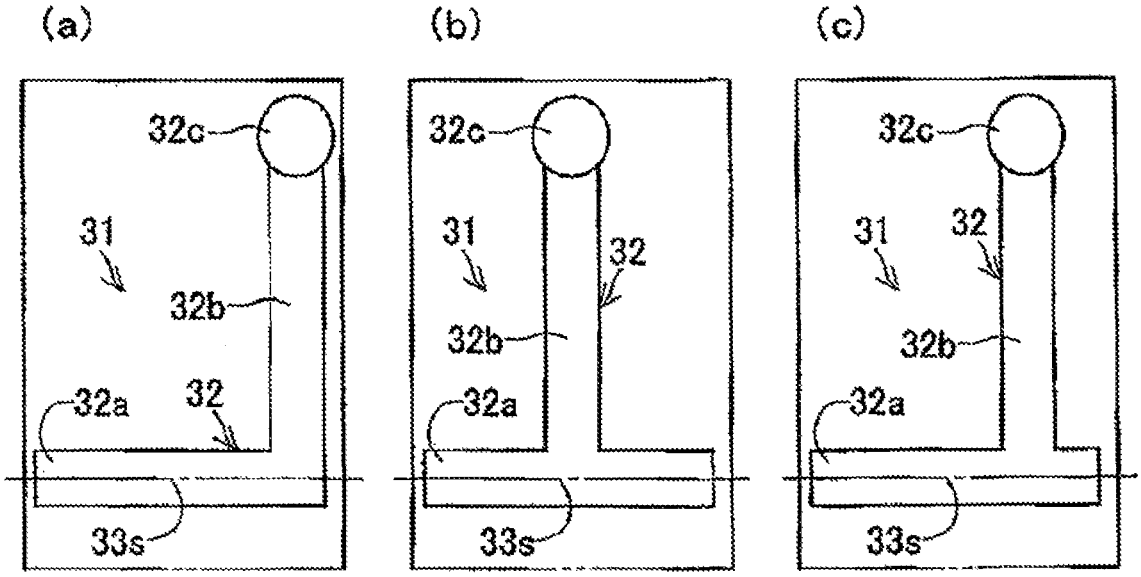
FIGS. 10(*a*), 10(*b*) and 10(*c*) are explanatory views of electrode patterns.

FIG. 9 is an explanatory view of a cross-sectional structure of the potential sensor and FIGS. 10(*a*), 10(*b*) and 10(*c*) are explanatory views of patterns of the thin film electrode layer.

As shown in FIG. 9, the potential sensor 30 includes the thin film electrode of the electroconductive material embedded in the film 31 of the insulating material. The film 31 may basically preferably possess a high insulative property and may preferably have an electrical resistivity of $1\times10^{12}$ to $1\times10^{18}$ Ω×cm. As a specific material, it is possible to use epoxy-based resin, imide-based resin, polyester-based resin, urethane-based resin, polystyrene-based resin, polyethylene-based resin, polyamide-based resin, ABS-based resin, polycarbonate resin, silicone-based resin, and the like. It is also possible to use plastic films or sheets such as films of diacetate resin, triacetate resin, polymethacrylate resin, cellophane, celluloid, polyvinyl chloride, polyimide resin, and polyphenylene sulfide. Further, an insulating rubber formed in a sheet may also be employed.

The film 31 is required to possess elasticity to some extent in order to cause bending deformation in direct contact with the photosensitive drum 1 and thus may preferably be formed of a material having Young's modulus of 0.001 to 10 GPa. The Young's modulus was obtained based on JIS-Z 1702 by simultaneously calculating strength and elongation through measurement of a test piece of 10 mm in width and 50 mm in length at a tension speed of 20 mm/min. by a testing machine ("TENSILON", mfd. by Toyo Boldwin Co., Ltd.). When the Young's modulus is less than 0.001 Gpa, the resultant film is excessively soft, so that the film cannot satisfactorily contact the photosensitive drum 1. On the other hand, when the Young's modulus is more than 10 Gpa, the resultant film is excessively hard, so that the film damages the photosensitive drum 1. For a material satisfying such a physical property, a polyester film or a polyimide film is most suitable.

The width (L2) of the potential sensor 30 may preferably be 1 to 320 mm, further preferably 2 to 10 mm. Below 1 mm, there is a possibility that the potential sensor 30 is broken from a view point of strength to fail to detect a signal. On the other hand, above 320 mm, the potential sensor 30 is excessively long to cause deformation or the like, thus causing signal non-uniformity.

The length (L3) of the potential sensor 30 may preferably be 1 to 50 mm. Below 1 mm, it is difficult to build a circuit, and there is a possibility that the photosensitive drum 1 contacts a supporting structure of the potential sensor 30 due to eccentric rotation or the like of the photosensitive drum 1. Above 50 mm, the potential sensor 30 is too large in size as a whole, thus causing breakage thereof in the image forming apparatus.

Inside the film 31, the thin film electrode layer 32 as the electroconductive member is located. A material for the thin film electrode layer 32 may preferably be electroconductive in order to detect induction current of the photosensitive drum 1 and may preferably have an electrical resistivity (JIS K-6911, at room temperature of 20° C.) of $1\times10^{-6}$ to $2\times10^{-4}$ Ω×cm. The electrical resistivity may further preferably be $1\times10^{-6}$ to $3\times10^{-6}$ Ω×cm. As a specific material, silver, copper, gold, aluminum, tungsten, iron, tin, lead, titanium, platinum, and the like may preferably be used. Of these materials, silver having a low electrical resistivity may particularly preferably be used.

When the electrical resistivity is lower than $1\times10^{-6}$ Ω×cm, it is generally difficult to obtain such a material under present circumstances. Further, the material shows excessively high electroconductivity, so that the potential sensor is liable to detect other noises. On the other hand, when the electrical resistivity is higher than $2\times10^{-4}$ Ω×cm, a signal sensitivity is somewhat worsened. The thin film electrode layer 32 may preferably have a thickness of 0.5 to 50 μm. Below 0.5 μm, the thickness of the film 31 is required to be made small. When the thickness of the film 31 is made small, sensitivity is excessively increased, so that the potential sensor detects an excess electrical noise. On the other hand, above 50 μm, the sensitivity is lowered, so that the potential sensor cannot detect the image deletion with high accuracy.

The potential sensor 30 contacts the photosensitive drum 1 at the outer curved surface of the film 31, so that the opposing distance between the detect electrode portion 32*a* and the photosensitive drum 1 surface is kept at a constant level. The opposing distance, i.e., the thickness of the film 31 may preferably be 5 to 100 μm, more preferably 15 to 50 μm. Below 5 μm, a signal strength of the detection electrode portion 32*a* is excessively increased, so that the potential sensor 30 is liable to detect noise due to surface oscillation of the photosensitive drum 1. Above 50 μm, the signal strength is decreased, so that the potential sensor 30 cannot detect the signal satisfactorily.

<Electroconductive Paste>

It is basically desirable that the thin film electrode layer 32 is prepared by changing a state of the above-described electroconductive material into an ink state (a paste state) and then subjecting a resultant electroconductive paste to pattern printing in a developed (extended) shape on the flat surface by using a printing method described below. To the electroconductive paste, it is possible to appropriately add a solvent, an antifoaming agent, an anti-setting agent, a dispersing agent, a coupling agent, a resistance-adjusting agent, and the like, as desired or in a commonly used range.

As the result, it is possible to select a solvent which does not react with thermosetting resin and is capable of dissolving a chelate-forming substance, oxygen acid capable of forming a complex with the chelate-forming substance, partial ester of the oxygen acid, or partial amide of the oxygen acid. For example, it is possible to use ethyl cellosolve, methyl cellosolve, butyl cellosolve, ethyl cellosolve acetate, methyl cellosolve acetate, butyl cellosolve acetate, ethyl carbitol, methyl carbitol, butyl carbitol, ethyl carbitol acetate, methyl carbitol acetate, butyl carbitol acetate, and the like.

It is possible to appropriately add a coupling agent, such as silane-based coupling agent, which is effective in electroconductivity within a range not deteriorating a pot life of the electroconductive paste. Preferred species of the coupling agent may include, e.g., γ-glycidoxypropyltrimethylsilane, γ-glycidoxypropyl-methyldiethoxysilane, N-(β-aminoethyl)-γ-aminopropyltrimethoxysilane, N-(β-aminoethyl)-γ-aminopropylmethyldimethoxysilane, β-(3,4-epoxycyclohexyl)ethyltrimethoxysilane, γ-aminopropyltriethoxysilane, N-phenyl-γ-aminopropyltrimethoxysilane, and the like. These coupling agents have volatility and safety requirements such that they have low reactivity with the thermosetting resin. An amount of the coupling agent may appropriately be determined depending on an amount of electroconductive powder to be contained in the electroconductive paste. An amount of the coupling agent is determined, in consideration of adhesiveness or the like, in a range of 1 to 10 wt. parts per 100 wt. parts of the electroconductive powder.

As the resistance-adjusting agent, it is possible to use metal oxides such as colloidal silica, titanium oxide, zinc oxide, and alumina; inorganic fine powder of silicon carbide, calcium carbonate, barium carbonate, calcium silicate, and the like; beads of polymers such as PMMA, polyethylene, nylon, silicone resin, phenolic resin, benzoquinamine resin, polyester, and the like; organic fine powder of fluorine-containing resin materials such as polytetrafluoroethylene and polyvinylidene fluoride; and fine powder of carbon black, acetylene black, channel black, aniline black, and the like. The resistance-adjusting agent may appropriately be added depending on a necessary resistance value.

Next, an example of a preparation method (manufacturing method) of the electroconductive paste will be described. Basically, the above-described electroconductive powder of the electroconductive material is a base material. To the base material, principal constituent components including the thermosetting resin, alkoxy group-containing modified silicone resin, the chelate-forming substance, and the oxygen acid or the partial ester or partial amide of the oxygen acid are added. Further, as desired, additives such as the coupling agent and the solvent are added. To the resultant mixture, shearing stress is applied so as to uniformly knead the mixture, so that the electroconductive paste is prepared. In a method of applying the shearing stress, e.g., an ordinarily used kneading device such as a kneader, a three-roll mill can be used. Particularly, as the kneading device, it is possible to suitably use a stone mill or stirring deaerator which permits kneading in a closed system and of a rotation-revolution combined use type (e.g., "MS-SNB-2000", mfd. by Matsuo Sangyo Co., Ltd.). The kneading may preferably be performed so that oxidation of the electroconductive powder does not proceed excessively.

As a manner of adding the various constituent components, it is possible to add all the components at one time. However, in order to ensure processing (treatment) of the electroconductive powder with the chelate-forming substance, first, the electroconductive powder may preferably be subjected to the processing with the chelate-forming substance in advance by adding the electroconductive powder into a solution of the chelate-forming substance in the solvent. The electroconductive paste may preferably be prepared by dividing the manufacturing method into a step of effecting the processing with the chelate-forming substance and a step of kneading the electroconductive powder processed with the chelate-forming substance with the thermosetting resin, a resin component such as the alkoxy group—containing modified silicone resin, and other additives to prepare a paste. In this case, during the step of effecting the processing with the chelate-forming substance, the oxygen acid or its partial ester or partial amide may further preferably be added in order to deactivate an excessive chelate-forming substance. Thus, by using a two-stage mixing step constituted by a first step and a second step, intended processing is performed in each of the steps, so that the resultant electroconductive paste is further stabilized with respect to an electroconductive performance and a storage property.

In the first step, the solvent is added to the electroconductive powder (e.g., copper powder) and the chelate-forming substance (e.g., 2,2'-bipyridyl), followed by high-speed stirring. At this time, eluted metal ions form a chelate with the chelate-forming substance, so that the color of the dispersion liquid is changed to blue.

To the dispersion liquid, the oxygen acid or its partial ester or partial amide is added in a predetermined amount so as to be uniformly mixed, so that the chelate-forming substance remaining after acting on the copper powder to form the chelate in the first step is deactivated. In the resultant liquid, copper ions derived from a natural oxide film at the copper powder surface are subjected to the chelate formation to be dissolved in the solvent and the electroconductive powder itself is dispersed in the solvent to result in a dispersion liquid. At the same time, other additives, which do not inhibit the above-described chelate forming process and are preferably dissolved in the solvent, such as the anti-setting agent and the dispersing agent can also be added.

In the second step, the thermosetting resin (e.g., resol-type phenolic resin) and the alkoxy group-containing modified silicone resin are added and stirred. At this time, the copper chelate is incorporated into the phenolic resin used as the thermosetting resin to be changed in color to black. Further, as desired, the additives such as the coupling agent, the anti-foaming agent, and an additional solvent are added and then a resultant mixture is kneaded by the above-described kneading device to complete the copper paste.

By the division into the above-described two steps, it is possible to process the electroconductive powder with the chelate-forming substance with reliability to further improve the electroconductive performance. Further, it is possible to prolong the pot life, shelf life, and the like. Incidentally, for the purpose of adjusting a viscosity, a volatile component, and the like of the electroconductive paste, it is also possible to add a further solvent.

As shown in FIGS. 10(*a*), 10(*b*), and 10(*c*), in the case where the electroconductive paste is used, it is possible to form various shapes of the thin film electrode layer 32. Specific examples of the shapes are shown in FIGS. 10(*a*), 10(*b*) and 10(*c*), but the shapes are not limited thereto. Basically, the shape of the thin film electrode layer 32 may preferably be such that the detection electrode portion 32*a* is formed in parallel to a folding line 33*s*, and the connecting wiring portion 33*b* is vertically extended continuously from a portion of a pattern of the detection electrode portion 32*a* to an output portion 32*c*. The electrode pattern is basically formed by printing, etching, vapor deposition, or the like, so that any of the patterns as shown in FIGS. 10(*a*) to 10(*c*) can be employed.

The formation of a developed electrode pattern can be effected by a general printing method such as a silk-screen printing method, a gravure printing method, a screen printing method, a method using a gravure plate, reverse-roll coating, sheet-fed printing, or offset printing.

Further, it is also possible to form the electrode pattern by a method in which masking is effected at a portion other than the electrode on the surface of the film 31 and thereon the electroconductive paste is applied or printed at the entire surface and is dried, followed by removal of the masking portion.

Further, it is also possible to employ a method in which masking of the electrode pattern is effected after the entire surface printing and then a portion which has not been subjected to the masking is removed by etching treatment to impart a desired shape to the electroconductive paste pattern.

Further, the thin film electrode layer 32 may also be formed by forming a thin metal film, through vacuum vapor deposition or sputtering, on the film on which a mask provided with an opening corresponding to the detection electrode portion 32*a* and the connecting wiring portion 32*b* is superposed.

Further, the detection electrode portion 32*a* and the connecting wiring portion 32*b* may also be formed into a pattern by forming a resist pattern on a thin metal film, which has been formed on the entire surface of the film 31 through the vacuum vapor deposition or the sputtering, and then by etching the resist pattern.

Further, as in the case of preparing a flexible printed board, the electrode pattern may also be formed by forming a resist pattern through projection exposure of a circuit pattern onto a resist layer on a thin metal film, and then by subjecting the resist pattern to etching treatment.

As shown in FIG. 9, in either case, the film 31, on which the detection electrode portion 32*a* is formed, is folded back in a shape curved in a half circle to form a semicircular curved surface portion contacting the photosensitive drum 1. A diameter of the semicircular curved end surface portion is characterized by being 10 to 600 μm. Below 10 μm, sensitivity is excessively high, so that an insufficient result is obtained even when noise suppression using shielding layers 37*a* and 37*b* is effected. On the other hand, above 600 μm, the curved end portion is excessively large, so that accuracy is lowered and elasticity is poor to harden the curved end portion, which damages the photosensitive drum 1.

<Shielding Layer>

Figure 11:
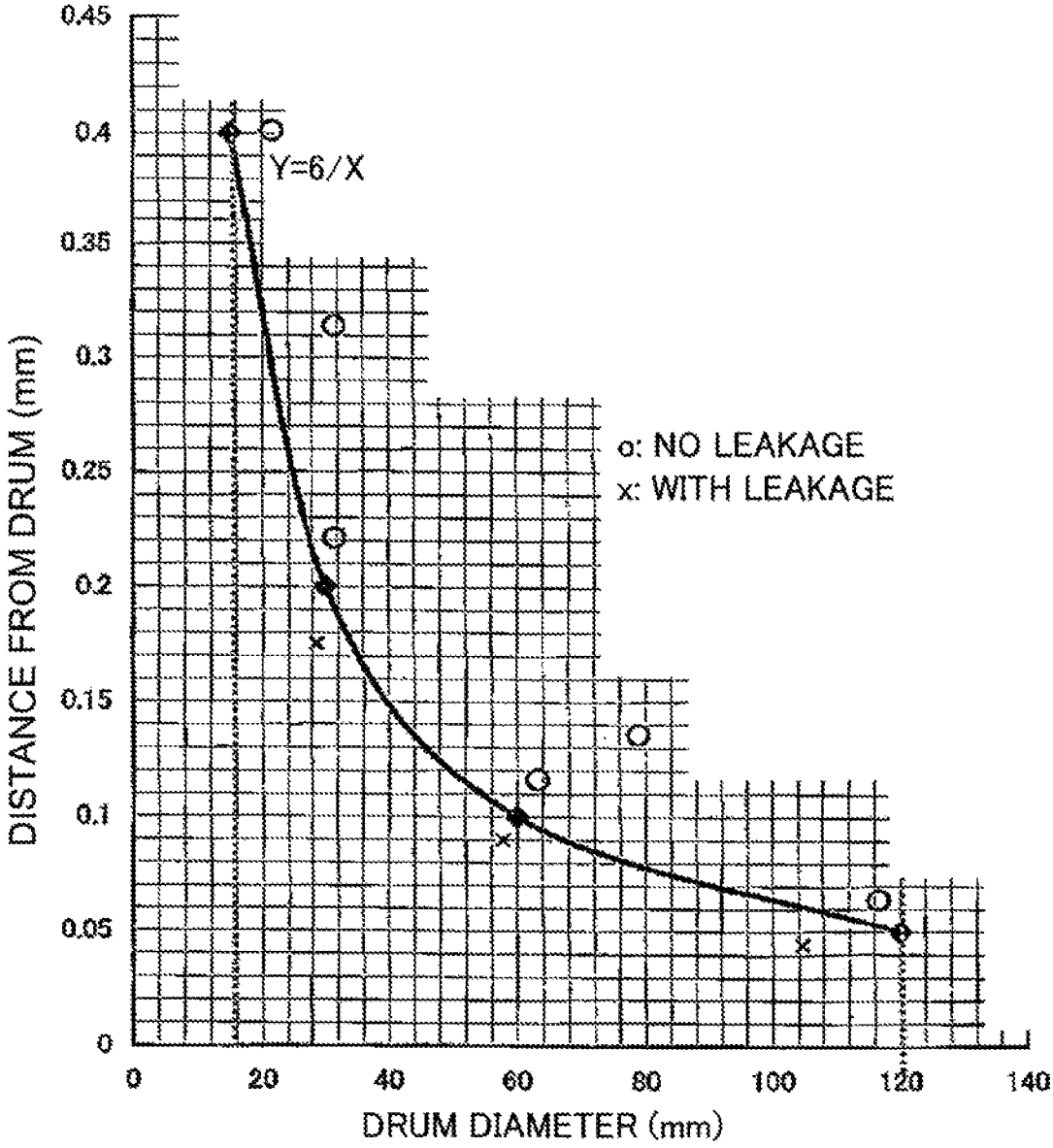
FIG. 11 is an explanatory view of a length of a contact area of a potential sensor end.
Figure 12:
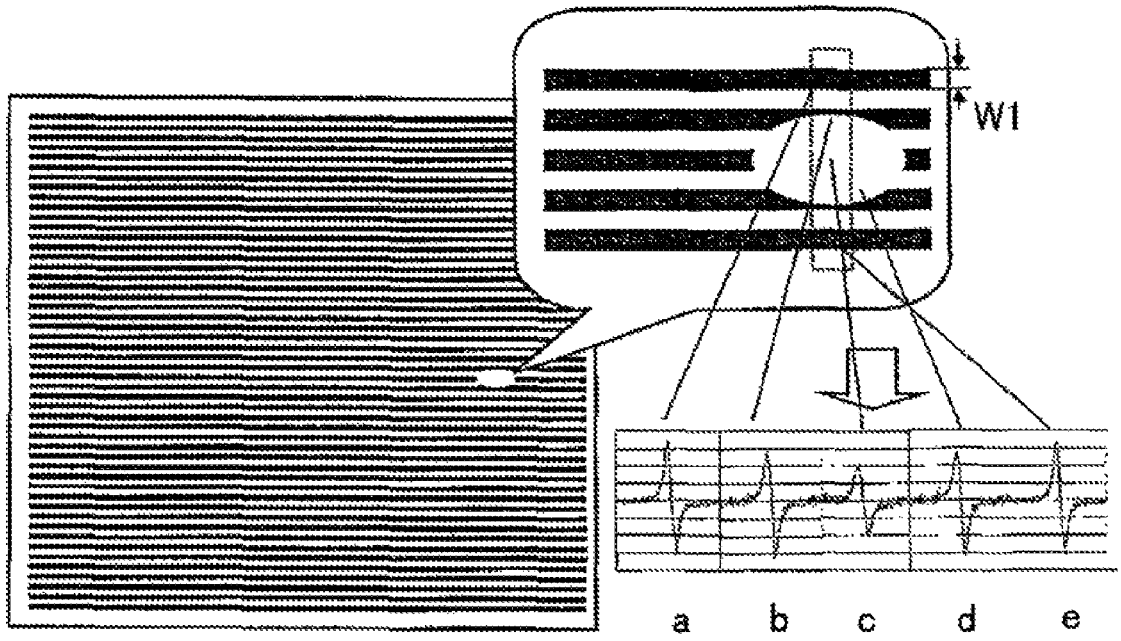
FIG. 12 is an explanatory view of a test image.
Figure 13:
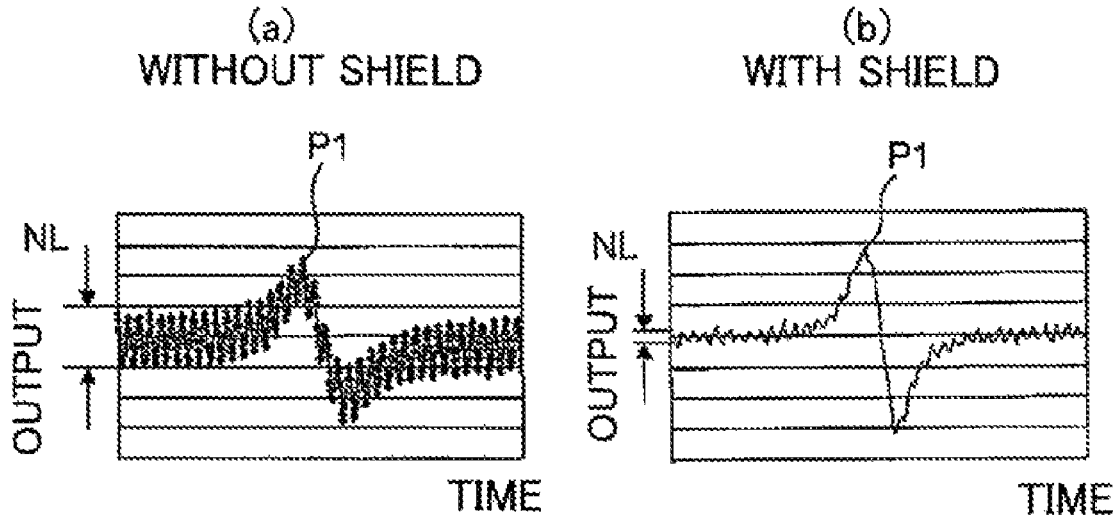
FIGS. 13(*a*) and 13(*b*) are explanatory views of an effect of noise suppression.

FIG. 11 is an explanatory view of a length of a contact area of a potential sensor end, FIG. 12 is an explanatory view of a test image, and FIGS. 13(*a*) and 13(*b*) are explanatory views of an effect of noise suppression.

For noise suppression, the shielding layers 37*a* and 37*b* are formed in a thin film through the above-described printing method by using the above-described electroconductive paste in an area except for the end portion (an area contactable to the photosensitive drum 1) of the potential sensor 30. As the electroconductive material for the thin film formation, there is no problem when the electroconductive material usable for the above-described thin film electrode layer 32 is employed. It is also possible to form the shielding layers 37*a* and 37*b* by using the above-described other materials for the thin film and the above-described other pattern forming methods. It is also possible to use a method in which masking is effected at a predetermined portion and the entire portion is soaked in the electroconductive paste and then is dried, followed by removal of the masking portion. It is also possible to coat both sides by vacuum vapor deposition or sputtering. Further, it is also possible to employ a method in which the material for the shielding layer is formed in a metal foil in advance, and then the entire surface is coated except for the end portion.

In this case, attention should be given to a manner of covering both (front and back) surfaces of the potential sensor 30. In a state of contact of the potential sensor 30 with the photosensitive drum 1, it is important to provide an uncovered portion, at which the photosensitive drum 1 is not covered with the shielding layer on the basis of a contact position, in a small area.

With respect to this uncovered portion, it was found that, as shown in FIG. 11, a diameter of the photosensitive drum 1 shows sensitivity. That is, a distance from each of a lower edge of the shielding layers 37*a* and 37*b* to the photosensitive drum 1 may preferably be in a range in which charge transfer between the photosensitive drum 1 and the shielding layers 37*a* and 37*b* is not caused to occur by the rotation of the photosensitive drum 1. The diameter of the photosensitive drum 1 is taken as D1 and a film 31—exposed distance from the shielding layer 37*a* to the shielding layer 37*b* at a portion close to the photosensitive drum 1 taken as D2. In this case, a condition for preventing the occurrence of the charge transfer, due to electric discharge or the like, to the shielding layers 37*a* and 37*b* with the rotation of the photosensitive drum 1 is summarized in the following formula from an approximate curve of FIG. 11.

$$D2 \geqq 6/D1 \ldots (15\ \text{mm} \leqq D1 \leqq 120\ \text{mm})$$

Therefore, when the end side of the potential sensor 30 is covered with the shielding layers 37*a* and 37*b* in a large amount, noise is lowered, so that sensitivity is improved. However, when the end side of the potential sensor 30 is covered with the shielding layers 37*a* and 37*b* in an excessively large amount, the electric discharge is caused to occur between the photosensitive drum 1 and the shielding layers 37*a* and 37*b* to cause leakage of electric charges of the electrophotographic image, so that an output signal itself is impaired. For that reason, for leakage prevention, it is preferable that at least the above-described range of D2 is not covered with the shielding layers 37*a* and 37*b*.

Further, heights H1 and H2 from the photosensitive drum 1 to the lower edges of the shielding layers 37*a* and 37*b* are also important. The heights H1 and H2 may preferably be 5 to 5000 μm. When the heights H1 and H2 are lower than 5 μm, slight leakage of current is caused to occur by vertical vibration of the end of the potential sensor 30 due to the eccentric rotation of the photosensitive drum 1, so that the detection cannot be effected. When the heights H1 and H2 are higher than 5000 μm, a shielding effect necessary for the detection electrode portion 32*a* is insufficient, so that noise of the output signal is increased and thus it is difficult to accurately detect the electrophotographic image.

Basically, the shielding layers 37*a* and 37*b* may preferably cover most of the cured end surface except for the contact area of the end of the potential sensor 30. As a result, the shielding layer 37*a* extending toward a downstream side with respect to the rotational direction R1 of the photosensitive drum 1 covers the curved end surface in a larger amount than that of the shielding layer 37*b* extending toward an opposite side.

The shielding layers 37*a* and 37*b* may preferably have a film (layer) thickness of 0.1 to 1000 μm. Below 0.1 μm, the shielding layers 37*a* and 37*b* cannot follow bending of the thin plate portion of the potential sensor 30 contacting the photosensitive drum 1 and are liable to crack or the like, so that disconnection or the like occurs. On the other hand, above 100 μm, the edges of the shielding layers 37*a* and 37*b* come near to the photosensitive drum 1, so that the electrode is liable to cause leakage.

As an angle at which the end of the potential sensor 30 contacts the photosensitive drum 1, in order that the end of the potential sensor 30 can follow the surface vibration of the photosensitive drum 1 by being brought into oblique contact with the photosensitive drum 1, a contact angle α formed between a direction normal to a rotation center of the photosensitive drum 1 and a direction of a center line of the potential sensor 30 extending to the contact point of the potential sensor 30 with the photosensitive drum 1 may preferably be 5 to 80 degrees. When the contact angle α is less than 5 degrees, followability with respect to the surface vibration of the photosensitive drum 1 is worsened, so that the signal is liable to be unstable. When the contact angle α is more than 80 degrees, the potential sensor 30 is liable to tangentially contact the photosensitive drum 1, so that the detection cannot be achieved satisfactorily. This is because the potential sensor 30 can detect a stable signal by ensuring the above-described heights H1 and H2 from the photosensitive drum 1 to the lower edges of the shielding layers 37*a* and 37*b*.

A linear pressure of the potential sensor 30 with respect to the photosensitive drum 1 may preferably be 0.01 mg/mm to 10 g/mm. When the linear is less than 0.01 mg/mm, the potential sensor 30 is in a substantially non-contact state with the photosensitive drum 1, so that signal stability is insufficient. When the linear pressure is larger than 10 g/mm, there is a possibility that the potential sensor 30 damages the photosensitive drum 1.

As shown in FIG. 12, the electrophotographic image during the image formation was detected by the potential sensor 30 and then an output signal was observed through an oscilloscope. A width W1 of the electrophotographic image for forming the image is 20-2000 μm, preferably 40-1000 μm. When the electrophotographic image is read in this range, it is possible to judge an image deletion state from the electrophotographic image with high accuracy. From FIG. 12, it is understand that a peak voltage of the output signal is changed depending a line width reproducibility of an image, developed from the electrophotographic image, indicated in an enlarged area.

FIGS. 13(*a*) and 13(*b*) show results of comparison of detected signals of electrophotographic images when images of FIG. 12 are formed by using two potential sensors 30 which are prepared in the same manner except that one potential sensors 30 is covered with the shielding layers 37*a* and 37*b* and the other potential sensor 30 is not covered with the shielding layers 37*a* and 37*b*. FIG. 13(*a*) shows an output signal of the potential sensor 30 which is not covered with the shielding layers 37*a* and 37*b*, and FIG. 13(*b*) shows an output signal of the potential sensor 30 covered with the shielding layers 37*a* and 37*b*.

As shown in FIGS. 13(*a*) and 13(*b*), when the noise suppression by using the shielding layers 37*a* and 37*b* is effected, compared with the case when the noise suppression is not effected, it is understood that the output signal is simple and clear, and thus a peak voltage P1 of the output signal is easily read. The peak voltage P1 of the output signal is, as shown in FIGS. 13(*a*) and 13(*b*), changed considerably depending on a degree of image defect after the development.

With a smaller amplitude NL of the noise signal, even a slight peak voltage can be detected accurately. On the other hand, when the noise signal amplitude NL is large, the peak voltage is buried in noise to be less readable, so that it is difficult to discriminate the peak voltage. Absolute values of the output voltage are not limited to those in FIGS. 13(*a*) and 13(*b*) since these values are changed depending on a power source or the like of an amplifying circuit. Further, the abscissa represents time, but the time varies depending on the image forming apparatus used, thus being not limited to that in FIGS. 13(*a*) and 13(*b*).

Figure 14:
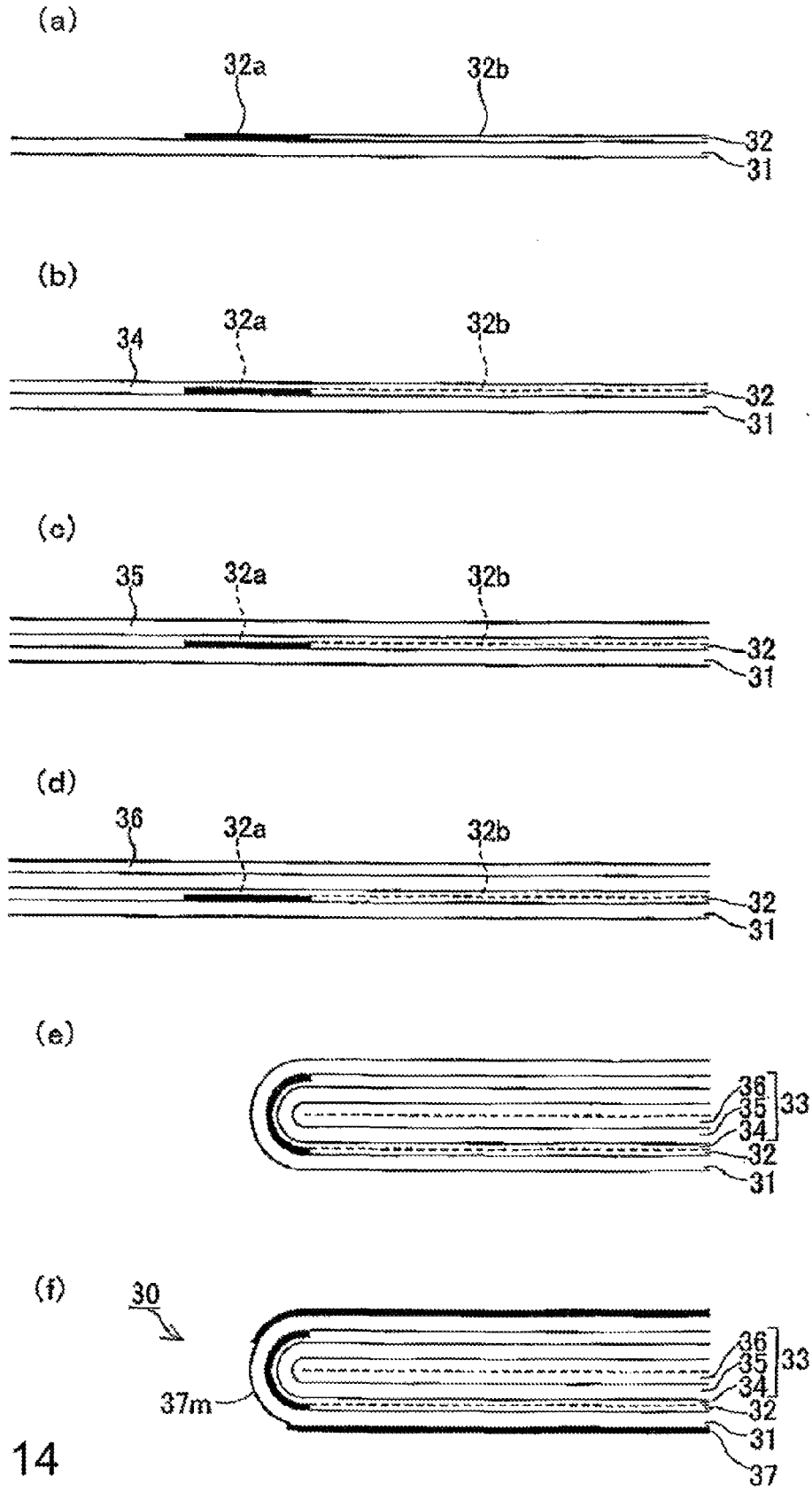
FIGS. 14(*a*) to 14(*f*) are explanatory views of a manufacturing method of the potential sensor.
Figure 15:
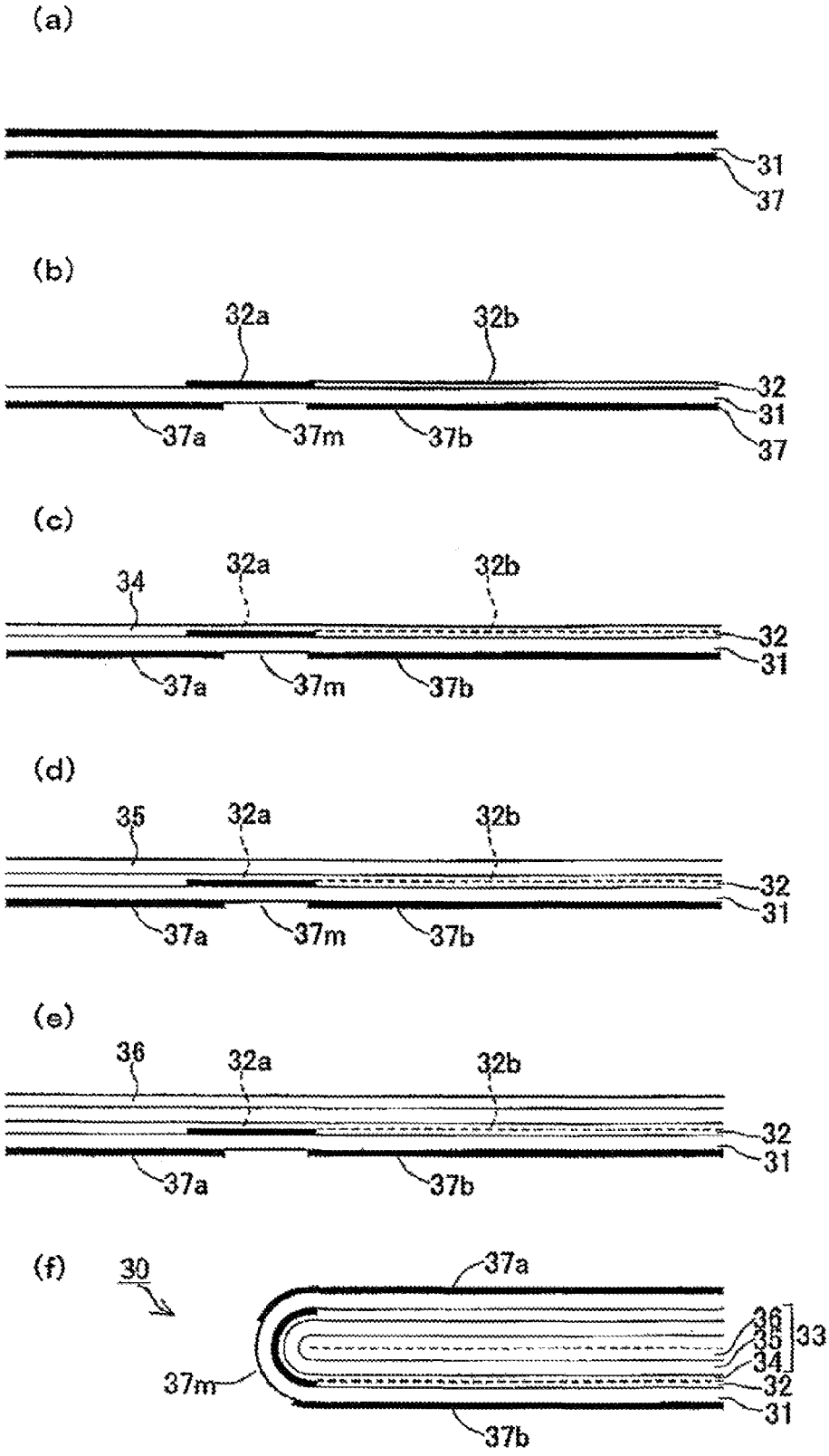
FIGS. 15(*a*) to 15(*f*) are explanatory views of another manufacturing method of the potential sensor.

FIGS. 14(*a*) to 14(*f*) are explanatory views of a manufacturing method of the potential sensor, and FIGS. 15(*a*) to 15(*f*) are explanatory views of another manufacturing method of the potential sensor.

The potential sensor manufacturing method shown in FIGS. 14(*a*) to 14(*f*) is based on formation of an electrode pattern of a printing type using the electroconductive paste.

As shown in FIG. 14(*a*), the electroconductive paste is printed in a predetermined pattern on the film 31 which is an insulating film by screen printing to form the thin film electrode layer 32 in an electrode pattern. In this case, it is preferable that the electroconductive paste of silver is used but the electroconductive paste is not limited thereto and may also be any of the above-described materials for the electroconductive paste.

On the film 31 and the thin film electrode layer 32, a cover layer 33 is provided. The cover layer 33 is constituted by an adhesive layer 34, a film layer 35, and an adhesive layer 36. First, as shown in FIG. 12(*b*), the adhesive layer 34 is applied onto the film 31 so as to cover the thin film electrode layer 32. Next, as shown in FIG. 14(*c*), onto the adhesive 34, the film layer 35 is applied. Then, as shown in FIG. 14(*d*), the adhesive layer 36 is applied onto the film layer 35.

Thereafter, as shown in FIG. 14(*e*), the entire structure is folded back along a center line of the detection electrode portion 32*a* to bond the film layer 35 back to back through the adhesive layer 36.

As shown in FIG. 14(*f*), the electroconductive paste is printed on the outer side surface of the film 31 by the screen printing to form a shield pattern. As a result, the shielding layers 37*a* and 37*b* are formed while leaving a portion 37*m* where the film 31 is exposed with a predetermined width. Incidentally, the shielding layers 37*a* and 37*b* may also be formed after the thin film electrode layer 32 is formed and before the cover layer 33 is provided. In this case, the shielding layers 37*a* and 37*b* can be formed with respect to the flat film 31, thus being easily formed.

Each of the thicknesses of the film 31 and the film 35 may be 5 to 100 μm, preferably 15 to 50 μm. Below 5 μm, strength of the thin plate-like portion of the potential sensor 30 is weakened, and thus the thin plate-like portion is broken, so that sensitivity non-uniformity of the potential sensor 30 occurs. Above 50 μm, the strength of the thin plate-like portion is excessively increased, so that the thin plate-like portion damages the photosensitive drum 1.

As an adhesive used for the adhesive layers 34 an 36, a general-purpose adhesive may preferably be used. Specific examples thereof may include adhesives of vinyl chloride type, vinylidene chloride type, natural rubber type, polyacrylate type, synthetic rubber type, acrylic type, acryl/styrene modified type, styrene-butadiene rubber type, isoprene rubber type, neoprene rubber type, neoprene-phenol type, butadiene rubber type, cured acrylic type, polyurethane type, and the like. The material for the adhesive layers 34 and 36 can be arbitrarily selected from these adhesives. The thickness of each of the adhesive layers 34 and 36 may preferably be 5 to 100 μm. Below 5 μm, an adhesive strength is lowered, so that a gap is liable to occur. When the thickness is above 100 μm, rigidity is excessively increased, so that there is a possibility of damage to the photosensitive drum 1.

The potential sensor manufacturing method shown in FIGS. 15(*a*) to 15(*f*) is based on formation of an electrode pattern of photographic seal engraving type using a sputtering pattern of a sputtering thin film.

As shown in FIG. 15(*a*), on both surfaces of the film 31, a thin metal film is formed in a uniform thickness by sputtering. A resist layer is formed on the thin metal layer formed on the both surfaces of the film 31 and is subjected to light exposure and development so as to leave portions corresponding to the thin film electrode layer and the shielding layers, to that electrode pattern formation and shield pattern formation are performed at the same time.

As shown in FIG. 15(*b*), the thin metal layer which is not covered with the resist layer is removed by etching, so that the thin film electrode layer 32 and the shielding layers 37*a* and 37*b* are formed.

As shown in FIG. 15(*c*), an adhesive layer 34 is applied onto the film 31 and the thin film electrode layer 32. As shown in FIG. 15(*d*), a center film layer 35 is applied onto the adhesive layer 34. As shown in FIG. 15(*e*), onto the center film layer 35, an adhesive layer 36 is applied. As shown in FIG. 15(*f*), the entire structure is folded back along a center line of the detection electrode portion 32*a* to bond the center film layer 35 back to back.

<Detection Principle of Potential Sensor>

The potential sensor 30 in this embodiment is configured to detect the surface potential of the photosensitive member on the basis of current induced in the thin film electrode layer.

In this case, there is a possibility of a lowering in S/N ratio of a detected signal due to radiation noise.

Therefore, as described above, the potential sensor 30 in this embodiment is covered with the shielding layer. During normal image formation, normal development cannot be effected when the application of the oscillating voltage to the developing sleeve 4*s* is terminated, so that the application of the oscillating voltage is not interrupted until the image formation is completed. However, when the test electrophotographic image 1*s* is detected by the potential sensor 30 provided with no shielding layer 37*a* in a state in which the oscillating voltage is applied to the developing sleeve 4*s*, high-frequency noise at high level appears in an output waveform measured by the oscilloscope. This is because radio wave noise generates due to an influence of an AC voltage component contained in the oscillating voltage and therefore the potential sensor 30 constitutes an antenna to detect the noise. For this reason, the shielding layer 37*a* is disposed and is connected to ground potential so as to keep the surface potential of the potential sensor 30 at the ground potential, so that an unnecessary AC voltage is prevented from being induced in the thin film electrode layer 32.

Incidentally, in this embodiment, high-frequency noise from the charging roller also influences the S/N ratio of the detected signal. For this reason, in order to prevent the S/N ratio of the detected signal from being lowered, the above-described shielding layer 37*b* is very effective.

Figure 6:
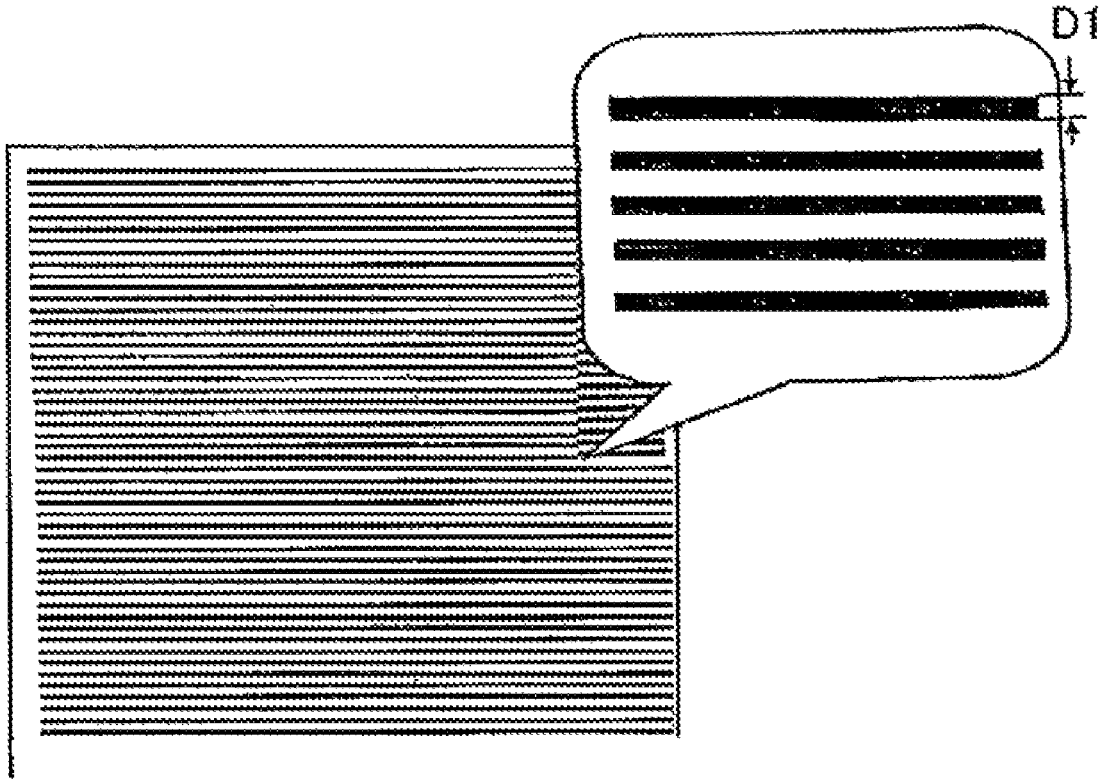
FIG. 6 is an explanatory view of an image with no image deletion.

As shown in FIG. 4, the control portion 110 executes a test mode before the image formation. In this test mode, the photosensitive member is electrically charged to the potential VD by the charger 2 and then a portion with the potential VL for reproducing a maximum image density is formed by the exposure device 3. Specifically, as shown in FIG. 6, the portion with the potential VL is formed so as to extend along a main scan direction and so as to have two-dot width (D1) with respect to a sub-scan direction. A plurality of line-like potentials with the potential VL is formed at predetermined intervals with respect to the sub-scan direction. In this embodiment, the resultant electrode is referred to as the test electrophotographic image 1*s*.

By the rotation of the photosensitive drum 1, the test electrophotographic image 1*s* including portions with the dark portion potential VD and portions with the light portion potential VL passes through the potential sensor 30. At this time, the detection electrode portion 32*a* opposes the photosensitive drum 1 with a constant distance, so that a voltage signal depending on a change in surface potential of the photosensitive drum 1 is detected by the detection electrode portion 32*a*.

Figure 8:
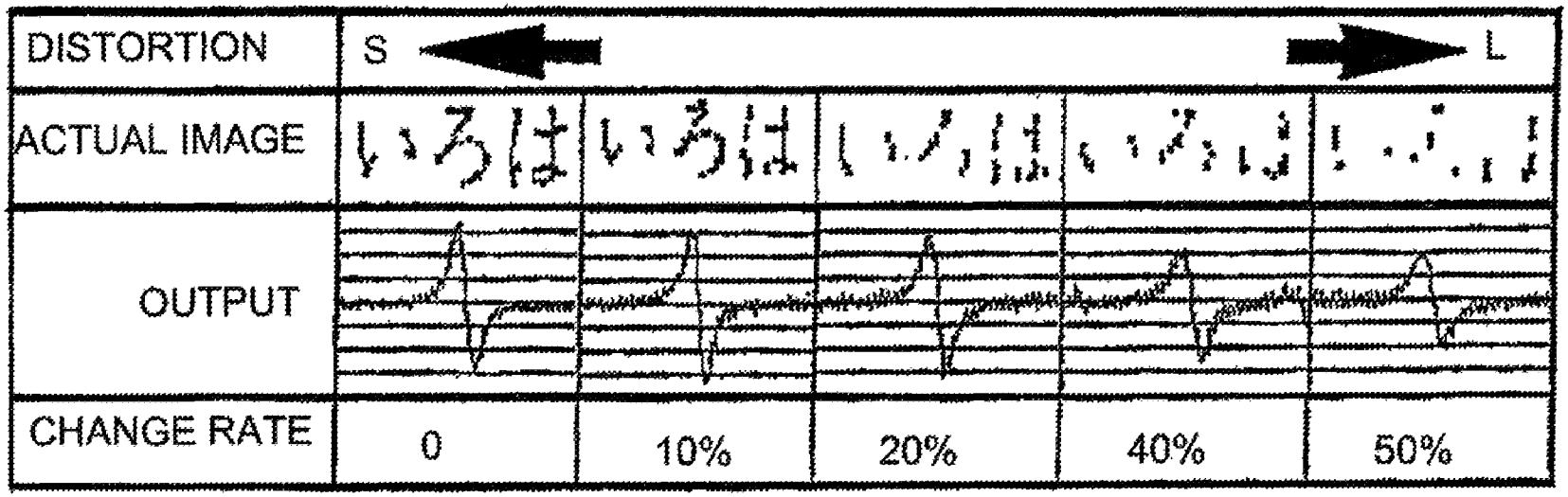
FIG. 8 is an explanatory view of a relationship between an output of the potential sensor and an image deletion state.

In a process in which the test electrophotographic image 1*s* comes near to the potential sensor 30, induced current flows from the detection electrode portion 32*a*, so that a voltage signal of a positive polarity is output. Thereafter, in a process in which the test electrophotographic image 1*s* has passed through the potential sensor 30 and moves away from the potential sensor 30, the induced current enters the detect electrode portion 32*a*, so that a voltage signal of a negative polarity is output. In this manner, an output waveform corresponding to differential waveform of potential distribution of the test electrophotographic image 1*s* is output from the potential sensor 30 (FIG. 8).

The potential sensor 30 outputs peaks of the output voltage at rising edge and falling edge of the potential distribution of the test electrophotographic image 1*s*. Positive and negative peak values of the output voltage corresponds to slopes of the edges of the potential distribution of the test electrophotographic image 1*s*. The control portion 110 determines the image deletion state on the photosensitive drum 1 without forming the toner image by measuring the peak values of the output voltage at the time when the potential sensor 30 detects the test electrophotographic image 1*s*.

As shown in FIG. 17, control portion 110 obtains the output of the potential sensor 30 through a signal processing circuit 120. The output voltage of the potential sensor 30 is amplified by an amplifying circuit 121, and then is converted into a digital value by an analog processing circuit 122 to be input into the control portion 110. The control portion 110 compares the measured peak voltage value with a reference value of the peak voltage measured in a low-temperature/low-humidity (L/L) environment in a state in which the photosensitive drum 1 is a fresh photosensitive drum.

Specifically, the signal processing circuit amplifies the voltage signal of the potential sensor 30 by the amplifying circuit 121 and outputs an analog voltage signal (V(a)) corresponding to the differential waveform of the potential distribution of the test electrophotographic image 1*s*. The analog processing circuit 122 detects positive and negative peak voltages VP1 and VP2 of the amplified analog voltage signal and converts the peak voltages PV1 and PV2 into digital peak voltages (A/D conversion). The resultant data is sent to the control portion 110 by output circuits 123 and 124. The control portion 110 obtains the positive and negative peak voltages VP1 and VP2, and then judges the slope of the edge of the potential distribution of the test electrophotographic image 1*s*.

An integrating circuit 125 integrates "the analog signal corresponding to the differential waveform of the potential distribution" output from the amplifying circuit 121 and outputs an analog voltage signal corresponding to the potential distribution (V(b)). An amplitude VP3 of this analog voltage signal is a value reflecting an electrophotographic image contrast of the test electrophotographic image 1*s* (i.e., the sum of a developing contrast (a difference between Vdc and VL) and a fog-removal voltage (a difference between VD and Vdc) in FIG. 5).

Here, the case where the detection electrode portion 32*a* and the surface of the photosensitive drum 1 are regarded as a capacitor with an opposing electrode distance d and the photosensitive drum 1-side potential is changed is considered. In this case, a voltage V output by the induced current entering and flowing from the detection electrode portion 32*a* changes depending on the opposing electrode distance d, so that the output voltage of the potential sensor 30 fluctuates by the eccentric rotation of the photosensitive drum 1 and vibration of the potential sensor 30.

$V=Q/C=k\times Q\times d/S$ (*k:* constant, *d:* opposing electrode distance, *S:* electrode area)

Accordingly, surface amplitude by movement is generated by the eccentric rotation or the like of the photosensitive drum 1, so that the output of the potential sensor 30 is changed by 10% only by fluctuation of 2.5 μm of the opposing electrode distance d of 25 μm.

In this regard, the potential sensor 30 contacts the photosensitive drum 1 at the curved end surface, so that an external mechanism or control for keeping the opposing distance between the detection electrode portion 32*a* and the photosensitive drum 1 at a constant level is not needed. The opposing distance can be kept at the constant level by the thickness of the film 31 while the curved end surface follows the eccentric rotation of the photosensitive drum 1.

Further, the potential sensor 30 obliquely contacts the surface of the photosensitive drum 1 so that the end thereof projects toward the rotational direction R1 in a plane perpendicular to a widthwise direction of the photosensitive drum 1. By the oblique contact, the potential sensor 30 end is urged upward by a frictional force with respect to the photosensitive drum 1 to be decreased in contact pressure, so that the potential sensor 30 can precisely follow the surface of the photosensitive drum 1 while keeping a stable small contact pressure even when the photosensitive drum 1 causes the eccentric rotation.

<Image Deletion>

Figure 5:
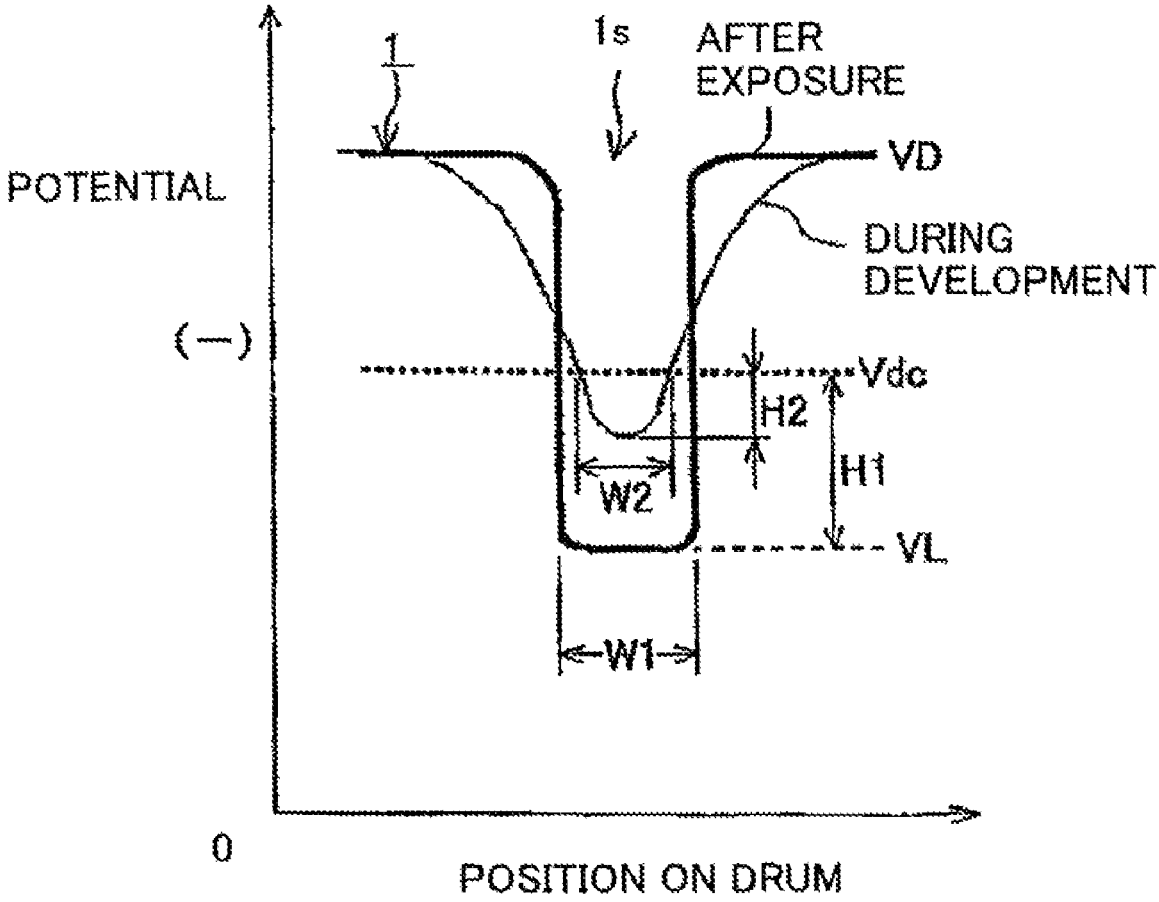
FIG. 5 is an explanatory view of an electrophotographic image causing image deletion.
Figure 7:
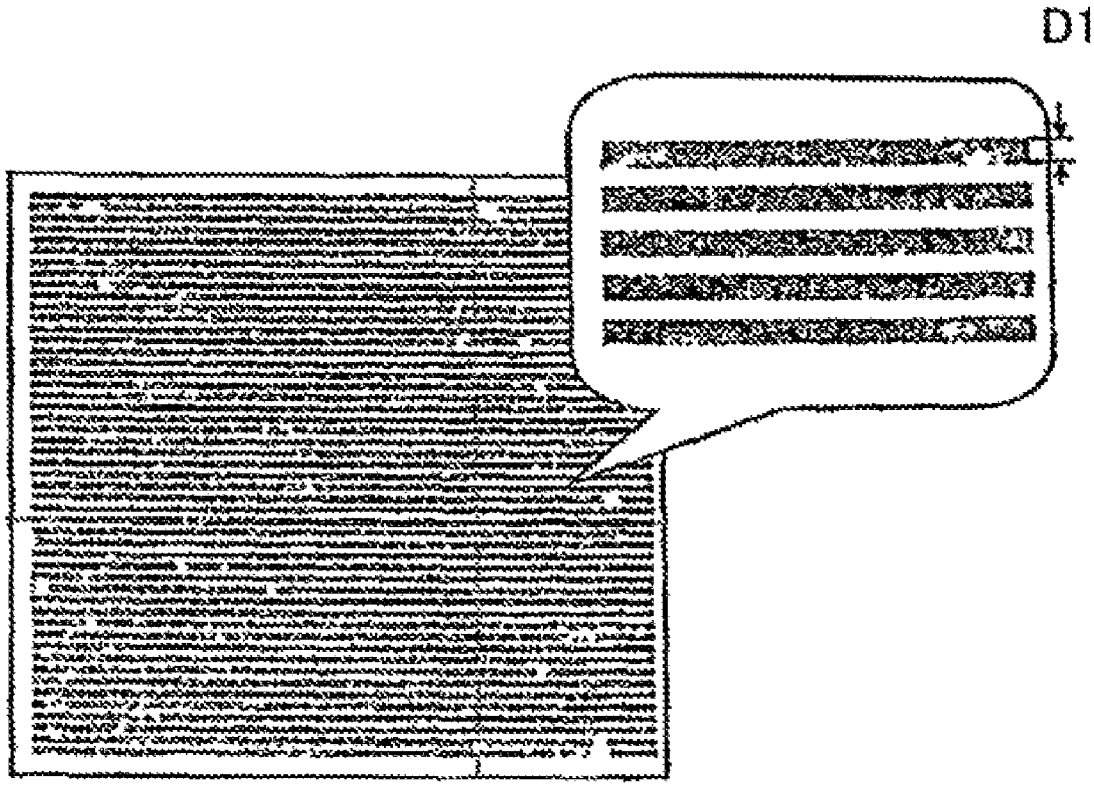
FIG. 7 is an explanatory view of an image with image deletion.

FIG. 5 is an explanatory view of the electrophotographic image capable of causing the image deletion, FIG. 6 is an explanatory view of an image with no occurrence of the image deletion, FIG. 7 is an explanatory view of an image with occurrence of the image deletion, and FIG. 8 is an explanatory view of a relationship between an output of the potential sensor and an image deletion state.

As shown in FIG. 1, the charging roller 2 effects the charging accompanied with electric discharge of the AC voltage, so that electric discharge products such as various nitrogen oxides NOx and ozone compounds X—$O_3$ are accumulated on the surface of the photosensitive drum 1. When the electric discharge products are accumulated on the surface of the photosensitive drum 1, surface hydrophilicity is enhanced and water content in the air is absorbed by the surface of the photosensitive drum 1 during a rest period, so that the surface of the photosensitive drum 1 is liable to take up moisture to lower a surface resistance with cumulative image formation.

As shown in FIG. 5, when the photosensitive drum 1 electrically charged to the dark portion potential VD is exposed to light to form (white) the test electrophotographic image 1*s*, the potential is lowered to the light portion potential VL only at an exposed portion immediately after the light exposure and a slope of the edge of the potential distribution is steep. However, when the surface resistance is lowered, electric charges are moved on the surface of the photosensitive drum 1 in a period from the exposure to the development and thus the edge of the potential distribution of the test electrophotographic image 1*s* is deformed to provide a gentle sloop, so that a potential peak value is also lowered. As a result, a line width W2 of an image developed from the test electrophotographic image 1*s* by the developing device by using the DC voltage Vdc is narrower than a line width W1 in the case where the surface resistance of the portion 1 is not lowered. Further, a potential difference H2 as the developing contrast between the DC voltage Vdc and a peak of the potential distribution is smaller than a potential difference H1 in the case where the surface resistance of the photosensitive drum 1 is not lowered, so that an amount of deposition of the toner is decreased and thus an image density is lowered.

The image deletion is liable to occur after the image forming apparatus is stopped and then is left standing for a long time. For this reason, the image deletion is less liable to occur during a continuous operation of the image forming apparatus 100. This is because a surface temperature of the photosensitive drum 1 is kept at a high level by radiation heat of the fixing device 8 and frictional heat of the cleaning blade 6*b* during the image formation and therefore the surface of the photosensitive drum 1 is drier than ambient portions due to a temperature difference to suppress adsorption of the water content.

However, when time has elapsed to some extent after the image forming apparatus is stopped, the surface temperature of the photosensitive drum 1 is lowered to the same temperature as the ambient portions. For this reason, the surface of the photosensitive drum 1 is more liable to adsorb the water content than the ambient portions in proportion to enhancement of hygroscopicity and hydrophilicity by the deposition of the electric discharge products.

First, an experiment causing the image deletion in a high-temperature/high-humidity (H/H) environment (30° C/80% RH) by using the photosensitive drum 1 which was made liable to cause the image deletion by being subjected to an image forming test on 100,000 sheets was conducted. By using the photosensitive drum 1 made liable to cause the image deletion, continuous image formation on 10,000 sheets of A4-sized plain paper with landscape feeding was performed in a one-sheet intermittent manner to form 40 lines per sheet of the test electrophotographic image 1*s* (line width (2 dots): 80 μm) extending in the main scan direction. As shown in FIG. 6, at this time, the image deletion was not caused to occur. This photosensitive drum 1 was left standing overnight and was subjected to similar image formation first thing in the next morning. As a result, the image deletion was caused to occur and as shown in FIG. 7, a part of the line image whitened and decreased in image density.

Next, the test electrophotographic image 1*s* was formed on the photosensitive drum 1 and subjected to image output and at the same time the potential distribution of the test electrophotographic image 1*s* was measured by using the potential sensor 30. Image deletion states different in level were intentionally generated by changing the temperature and the humidity, the type of the photosensitive drum 1, rest time, rest environment, and the like, so that a relationship with a peak value of an output signal of the potential sensor 30 was investigated.

As shown in FIG. 8, under each of respective conditions, different in image deletion level, the test electrophotographic image 1*s* was detected by the potential sensor 30 to record an output signal, and then a character image with a line width of 100 μm was formed. As a result, the image deletion states different in level were reproduced in the character images, so that detection signals corresponding to the different image deletion levels were obtained. In FIG. 8, a change rate is a signal strength change rate representing a percentage (%) of a change in peak voltage, under an associated image deletion condition, on the basis of a reference signal taken as a pre-measured peak voltage of 120 mV of an output signal for a fresh photosensitive drum 1.

As a result, it was confirmed that the degree of the image deletion of the formed image and the peak voltage of the obtained output signal showed high correlativity. Accordingly, by measuring the peak voltage of the detection signal of the test electrophotographic image 1*s* with the use of the potential sensor 30, it was confirmed that an occurrence of the image deletion was sufficiently predictable.

The control portion 110 as a controller executes a refresh mode for refreshing the photosensitive drum 1 when a slope of a potential of the test electrophotographic image 1*s* from the light portion potential to the dark portion potential is gentler than a predetermined slope. Further, an execution time of the refresh mode for refreshing the photosensitive drum 1 is prolonged with the potential slope gentler than the predetermined slope.

In the refresh mode, a processing in which the photosensitive drum 1 is idled is performed. During the idling, the photosensitive drum 1 is rubbed with the cleaning blade 6*b*, so that the water content deposited on the surface of the photosensitive drum 1 is removed. By this removal of the water content, it is possible to avoid the above-described image deletion phenomenon.

Further, it is also possible to employ such a constitution that the refresh mode is executed when the potential slope of the test electrophotographic image 1*s* from the dark portion potential to the light portion potential is detected and the detected potential slope is gentler than the predetermined slope.

The idling time in the refresh mode is set depending on the peak voltage of the output signal of the potential sensor 30 so that the idling time is set at a larger value with a smaller peak voltage Vp.

Incidentally, as described in JP-A 2002-40876, the surface resistance may be restored by using a heater as a heating device contained in an inner hollow portion of the photosensitive drum. In this case, an energization time of the heater may be set at a larger value with a smaller peak voltage Vp.

In either case, the potential of the test electrophotographic image 1*s* is measured by the potential sensor 30 and a control time for restoring the surface resistance of the photosensitive drum 1 is set depending on a measurement result. Then, with completion of the control for restoring the surface resistance (the refresh mode) for the set time, image formation is started. Incidentally, in the case where the refresh mode is executed during warm-up immediately after a main switch is turned on, a warm-up sequence is completed by stopping the rotation of the photosensitive drum 1 with the completion of the refresh mode.

<Sequence of Refresh Mode>

Then, a sequence of the refresh mode will be described.

Figure 18:
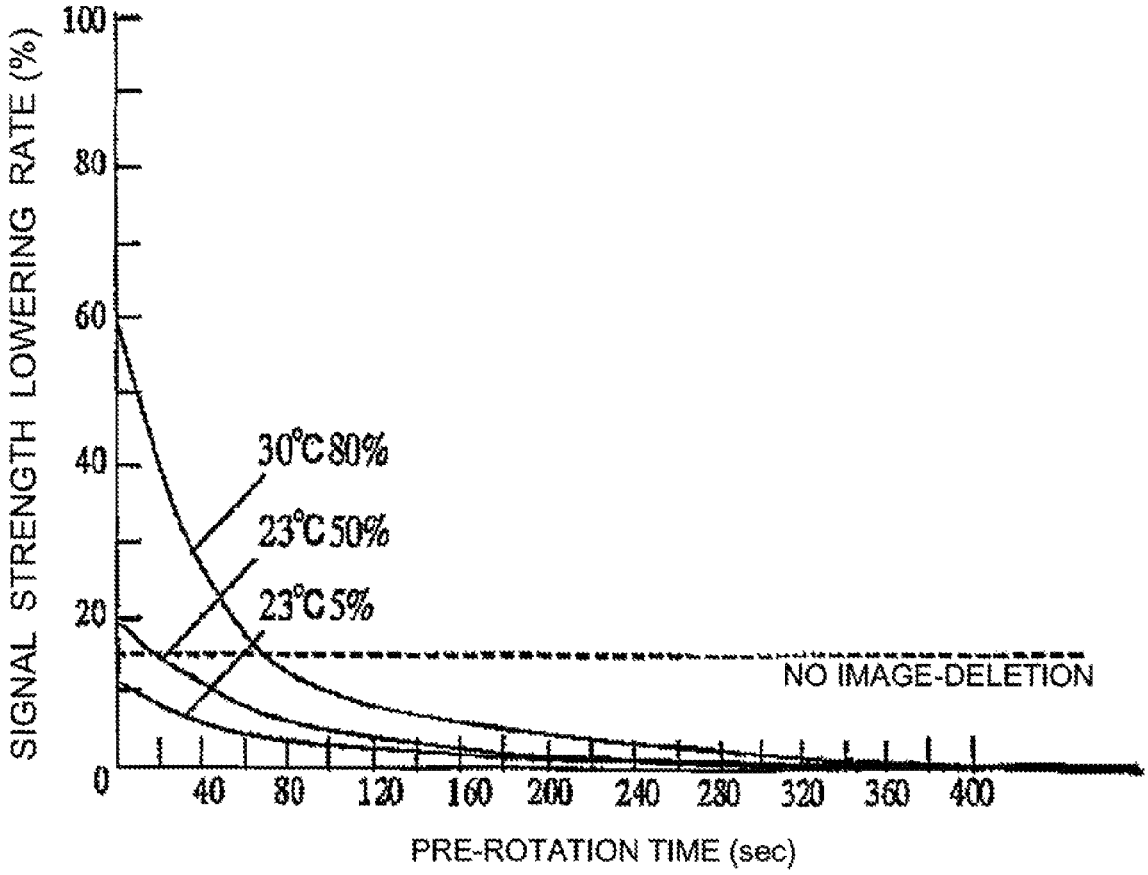
FIG. 18 is a graph for illustrating a state of recovery of an output of the potential sensor by idling of the photosensitive drum.

As shown in FIG. 18, in the case of the high-temperature/high-humidity environment (H/H: 30° C./80% RH), the peak voltage of the detection signal of the test electrophotographic image 1*s* was restored to 85% of the reference value by the idling for 70 sec.

In the case of a normal-temperature/normal-humidity environment (N/N: 23° C./50% RH), the peak voltage of the detection signal of the test electrophotographic image 1*s* was restored to 85% of the reference value by the idling for 20 sec.

In the case of a normal-temperature/low-humidity environment (N/L: 23° C./5% RH), the water content causing the image deletion is very small in this environment, so that the peak voltage of the detection signal of the test electrophotographic image 1*s* was 85% or more from the initial stage. For this reason, the execution of the refresh mode in which the photosensitive drum 1 was idled was not needed.

The image deletion is liable to occur immediately after the standing of the image forming apparatus 100 and is less liable to occur during the continuous operation of the image forming apparatus 100. Therefore, as a measuring against the image deletion, a method of executing the refresh mode concentratedly during pre-rotation at the time of actuating the image forming apparatus 100 or pre-rotation, before image formation, at the time of re-actuating the image forming apparatus 100 after stand-by in a sleep mode is effective.

Figure 19:
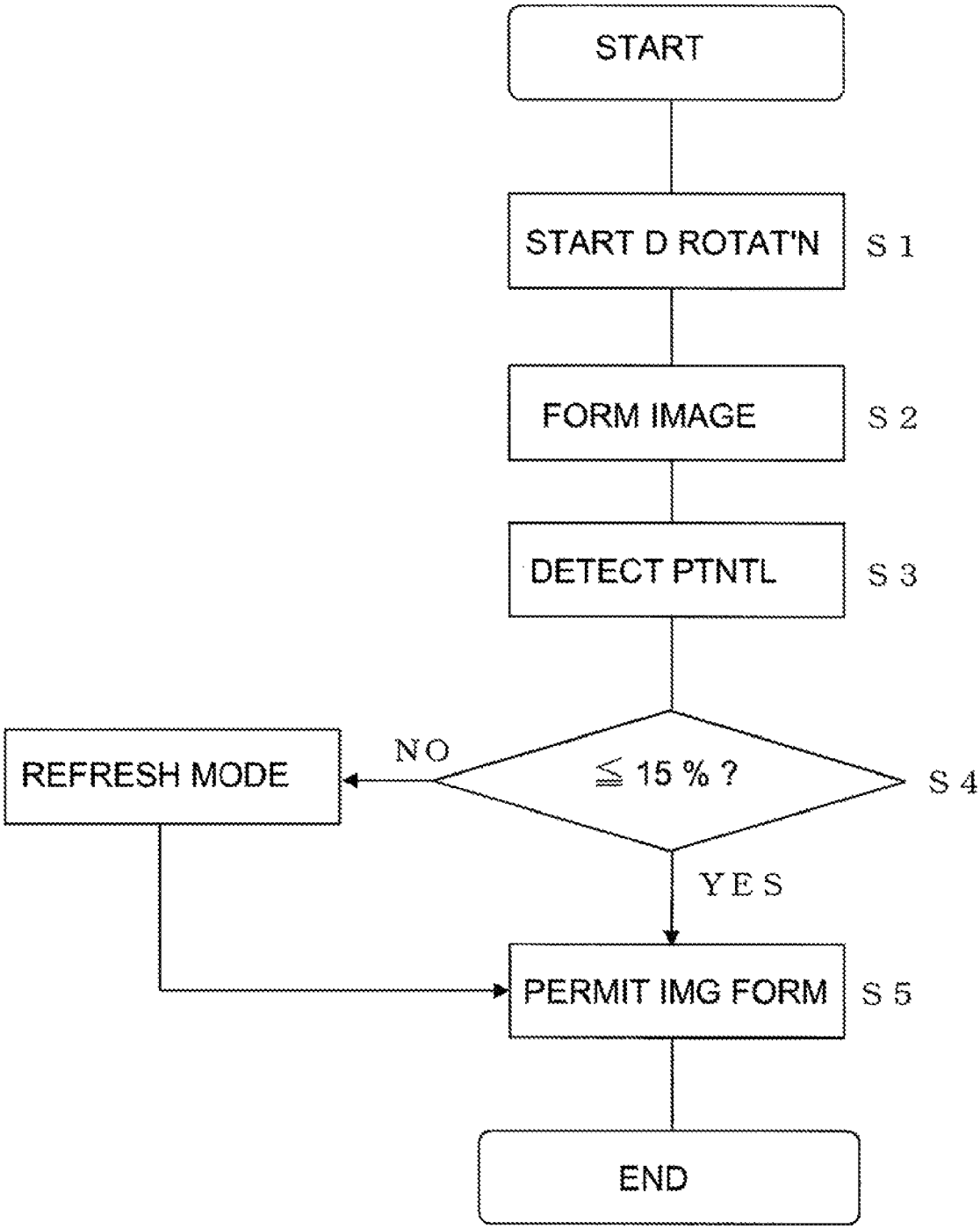
FIG. 19 is a flow chart of a refreshing mode.

FIG. 19 is a flow chart of the control. Along the flow chart, the control is carried out by controlling various devices by the control portion 110 as the controller.

In this embodiment, as described above, a lowing in peak height of 15% on the basis of the reference value of the detection signal is taken was a threshold value for determining whether or not the measure against the image deletion is taken or not.

As shown in FIG. 19, the control portion 110 starts rotation of the photosensitive drum 1, as a preparatory processing for image formation, by controlling a driving motor 1M during the actuation of the image forming apparatus 100 and during receiving of an image forming job (S1).

The control portion 110 forms the test electrophotographic image 1*s* (FIG. 6) on the photosensitive drum 1 (S2). Simultaneously, the formed (written) test electrophotographic image 1*s* is detected by the potential sensor 30 immediately (S3). Values of a peak height obtained from the signal processing circuit 120 are held in a storing device of the control portion 110 (S3).

The control portion 110 extracts a peak height in a lowest area from the peak height values (S4).

The control portion 110 sends an image formation enabling signal when a peak height of 85% or more of the reference value (i.e., a peak height in a range within 15% or less of the reference value) is detected (S4).

On the other hand, the control portion 110 executes the refresh mode when a peak height of less than 85% is detected (S6). In this refresh mode, as described above, the idling of the photosensitive drum 1 is performed, so that the water content is removed by the rubbing with the cleaning blade.

When the refresh mode is completed, the image formation enabling signal is sent.

According to this control, the state of the image deletion can be converted into a signal by detecting the electrophotographic image, so that the image deletion state can be stably detected with high accuracy. Therefore, it is possible to avoid the occurrence of the image deletion, so that it is possible to present the occurrence of the image defect.

<Another Embodiment of Detection Electrode>

Figure 16:
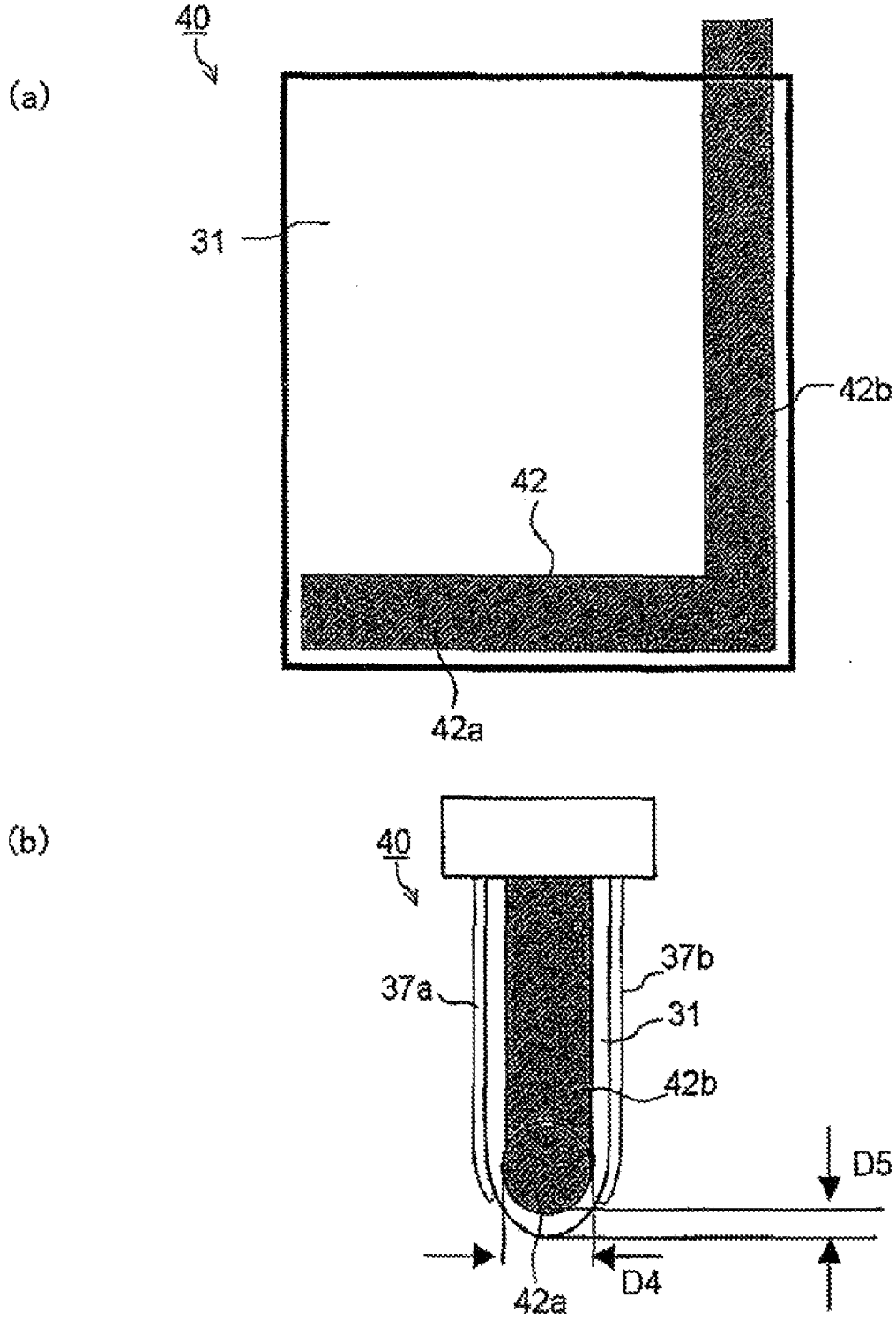
FIGS. 16(*a*) and 16(*b*) are explanatory views of examples of a detection electrode.

FIGS. 16(*a*) and 16(*b*) are explanatory views of another detection electrode.

As another detection electrode buried in the end portion of the potential sensor 30, a wire type detection electrode described in JP-A Hei 11-183542 and JP-A 2004-77125 is used.

Outside an L-shaped wire 42 shown in FIG. 16(*a*), a film 31 is bonded as shown in FIG. 16(*b*) to prepare a potential sensor 40. As a material for the wire 42, a substance of W, Au, Pt, Cu, Fe, Ti, Cr, Ag, Ta, or the like is excellent in electroconductivity, thus being suitable for the potential sensor 40. Of these substances, W is excellent in easy processing property, thus being totally most suitable for the potential sensor 40.

In this case, a wire diameter D4 of the wire 42 used largely affects detection resolving power of the potential sensor 40. Basically, the wire diameter D4 may desirably be small but a thickness D5 of the film 31 is required to be larger with a decreasing wire diameter D4, so that a signal strength is rather lowered. For this reason, there is a lower limit with respect to the wire diameter D4.

The wire diameter D4 may desirably be 1 to 500 μm.

Example 1

As shown in FIGS. 14(*a*) to 14(*e*), the respective layers were laminated and folded back to prepare the potential sensor and thereafter the shielding layers 37*a* and 37*b* were formed on both surfaces of the potential sensor by effecting selective aluminum vapor deposition. Materials for the respective layers were selected as follows.

Film 31 and center film layer 35: PET ("Lu-mirror", mfd. by Toray Industries, Inc.), thickness=25 μm, width=2.5 mm, length=45 mm, Young's modulus=2.7 GPa, resistance=$1\times10^{15}$ Ω×cm.

Thin film electrode layer 32: silver paste ("K-3424", mfd. by K.K. Shinto Chemitron), resistance=$1.59\times10^{-6}$ Ω×cm.

Electrode pattern: L-shaped pattern of FIG. 10(*a*), width=212 μm, length=2 mm, thickness=10 μm.

Adhesive layers 34 and 36: acrylic type adhesive ("Olibain", mfd. by Toyo Ink Mfg. Co., Ltd.), thickness=20 μm, bar coater application and drying.

Folding back position: 20 mm from the end.

As shown in FIG. 14(*f*), the shielding layers 37*a* and 37*b* were formed on the both surfaces of the potential sensor 30. A primer layer was formed at the end portion so as to mask an area of 25 μm on a drum non-contact side and an area of 250 μm on a drum contact side. The potential sensor 30 was placed in a vacuum (vapor) deposition machine (a bell-jar testing vapor deposition machine, "EBV-6DH", mfd. by Nippon Shinku Gijutsu K.K.) and above the potential sensor 30, ink for aluminum vapor deposition ("LPVMS", mfd. by Toyo Ink Mfg. Co., Ltd.) was disposed. Then, vapor source (99.99% aluminum) was disposed with a distance of about 30 cm. The inside of the deposition machine was evacuated to a pressure of $4\times10^{-7}$ Pa ($3\times10^{-5}$ Torr). Thereafter the vapor deposition was performed to form a 10 μm-thick aluminum deposition layer on the exposed portion of the film 31 and the primer layer. The aluminum deposition layer had an electric resistance of $2.65\times10^{-6}$ Ω×cm. Then, the primer layer was dissolved in an organic solvent to remove the aluminum thin film at the masking portion, so that the shielding layers 37*a* and 37*b* were provided to the potential sensor 30.

As shown in FIGS. 4 and 17, such a constitution that a signal output from the amplifying circuit 121 connected to the thin film electrode layer 32 of the potential sensor 30 was input into the A/D converter 122 and a level of the image deletion was judged through the control portion 110 was employed. A setting angle for bringing the end of the potential sensor 30 into contact with the photosensitive drum 1 was 15 degrees and a thin plate-like side surface of the potential sensor 30 was bent so as to provide a pressing force of 0.1 g/mm.

Onto the photosensitive drum 1, a slight amount of a finger mark (finger oil) was intentionally applied at one position. By using the photosensitive drum 1, in the high-temperature/high-humidity environment (30° C./80% RH), image formation of a line image including 40 lines with a line width of 100 μm and a line interval of 100 μm as shown in FIG. 12 was effected on sheets of A4-sized plain paper in a landscape feeding manner. At that time, the resultant image was deleted at a position corresponding to the finger mark (oil) portion to expose the white background. When the finger mark portion was subjected to measurement by the potential sensor 30, a resultant peak voltage value of the output signal was lowered by about 50% compared with the case of image formation before the finger mark was applied onto the photosensitive drum 1.

Example 2

As shown in FIGS. 14(*a*) to 14(*e*), the respective layers were laminated and folded back to prepare the potential sensor and thereafter the shielding layers 37*a* and 37*b* were formed on both surfaces of the potential sensor by application of copper paste. Materials for the respective layers were selected as follows.

Film 31 and center film layer 35: polyimide film ("Kapton", mfd. by DuPont-Toray Co., Ltd.), thickness=100 μm, width=2.5 mm, length=45 mm, Young's modulus=1.96 GPa, resistance=$1\times10^{16}$Ω×cm.

Thin film electrode layer 32: copper paste ("CUX-R", mfd. by K.K. Mitsuboshi Belting Ltd.), resistance=$1.68\times10^{-6}$ Ω×cm.

As shown in FIG. 14(*a*), the copper paste was printed on the entire surface in a thickness of 15 μm and thereon an ordinary etching resist ink ("PSR-4000H", mfd. by Taiyo Ink Mfg. Co., Ltd.) was applied by screen printing to mask a conductor pattern portion of the thin film electrode layer 32. The resultant structure was subjected to etching treatment with cupric chloride as an etching liquid, followed by removal of the resist mask to obtain an electroconductive pattern as shown in FIG. 10(*c*).

Through the steps shown in FIGS. 14(*b*) to 14(*e*), the potential sensor was formed and masking was made in an area of 15 μm on a photosensitive drum non-contact side of the potential sensor and in an area of 210μm on a photosensitive drum contact side of the potential sensor. Then, the resultant structure was immersed in copper paste used for the thin film electrode layer 32, followed by drying and then removal of the masking portion to provide the shielding layers 37*a* and 37*b* as shown in FIG. 14(*f*).

The thus-prepared potential sensor 30 was also subjected to the same evaluation as in Example 1.

Onto the photosensitive drum 1, a slight amount of the finger mark (finger oil) was intentionally applied at one position. By using the photosensitive drum 1, in the high-temperature/high-humidity environment (30° C./80% RH), image formation of a horizontal line image with a line width of 100 μm as shown in FIG. 12 was effected. At that time, the resultant image was deleted at a position corresponding to the finger mark (oil) portion to expose the white background. When the finger mark portion was subjected to measurement by the potential sensor 30, a resultant peak voltage value of the output signal was lowered by about 60% compared with the case of image formation before the finger mark was applied onto the photosensitive drum 1.

Example 3

The potential sensor 40 using the wire electrode as shown in FIGS. 16(*a*) and 16(*b*) was prepared.

Film 31: polyphenylene sulfide film ("Torelina", mfd. by Toray Industries, Inc.), thickness=100 μm, electric resistance=$1\times10^{16}$ Ω×cm, Young's modulus=2.5 GPa.

Wire electrode: Tungsten wire, diameter=50 μm.

As shown in FIGS. 16(*a*) and 16(*b*), the tungsten wire was shaped and outside the tungsten wire, the film 31 was folded back and bonded.

The photosensitive drum 1 was damaged to leave a scar of about 200 μm in diameter and then was subjected to the same evaluation as in Example 1. The photosensitive drum 1 was subjected to image formation of a horizontal line image with a line width of 100 μm on plain paper as shown in FIG. 12 in the low-temperature/low humidity environment (15° C/10%RH). At that time, the resultant image was deleted at a position corresponding to the scar portion to expose the white background. When the finger mark portion was subjected to measurement by the potential sensor 40, a resultant peak voltage value of the output signal was lowered by about 65% compared with the case of image formation before the photosensitive drum 1 was damaged to leave the scar portion.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 225396/2008 filed Sep. 3, 2008, which is hereby incorporated by reference.

What is claimed is:

1. A potential sensor for detecting a surface potential of an electrophotographic photosensitive member, comprising:

an insulative film;

a thin film electrode layer formed on said insulative film;

a curved portion formed by folding back said insulative film so that said thin film electrode layer is inwardly located, said curved potion functioning as a detecting portion for detecting the surface potential of the electrophotographic photosensitive member in contact with the electrophotographic photosensitive member; and an electro conductive shielding portion provided so as to cover an outer surface of said insulative film except for at least an area in which said curved portion is contactable to the electrophotographic photosensitive member, said shielding portion being electrically grounded.

2. The potential sensor according to claim 1, wherein said shielding portion is provided so as to cover an entire outer surface of said insulative film except for at least the area in which said curved portion is contactable to the electrophotographic photosensitive member.

3. The potential sensor according to claim 1, further comprising an insulative cover layer, provided so as to cover said thin film electrode layer, for preventing contact between opposing portions of said thin film electrode layer located at said curved portion.

4. The potential sensor according to claim 3, wherein said cover layer having opposing portions which contact each other adhesively by folding back said insulative film.

5. An electrophotographic image forming apparatus, comprising:

an electrophotographic photosensitive member;

an image forming device for forming an electrophotographic image on said electrophotographic photosensitive member; and a potential sensor for detecting a surface potential of said electrophotographic photosensitive member, wherein said potential sensor comprises:

an insulative film;

a thin film electrode layer formed on said insulative film;

a curved portion formed by folding back said insulative film so that said thin film electrode layer is inwardly located, said curved potion functioning as a detecting portion for detecting the surface potential of said electrophotographic photosensitive member in contact with said electrophotographic photosensitive member; and an electroconductive shielding portion provided so as to cover an outer surface of said insulative film except for at least an area in which said curved portion is contactable to said electrophotographic photosensitive member, said shielding portion being electrically grounded.

6. The electrophotographic image forming apparatus according to claim 5, further comprising a control portion for controlling said image forming device so as to form a predetermined electrophotographic image on said electrophotographic photosensitive member and determining whether or not image formation start is permitted on the basis of an output of said potential sensor.

7. The electrophotographic image forming apparatus according to claim 6, further comprising a rubbing member for rubbing said electrophotographic photosensitive member, wherein said control portion executes a mode in which said electrophotographic photosensitive member is rubbed with said rubbing member when the image formation start is not permitted.

8. The electrophotographic image forming apparatus according to claim 7, wherein said control portion executes the mode when a slope of potential from a dark portion potential to a light portion potential of the predetermined electrophotographic image is judged as being gentler than a predetermined slope.

9. The electrophotographic image forming apparatus according to claim 8, wherein said control portion controls a rubbing time of said electrophotographic photosensitive member with said rubbing member depending on the output of said potential sensor.

10. The electrophotographic image forming apparatus according to claim 9, wherein said rubbing member includes a blade for removing toner deposited on said electrophotographic photosensitive member.

11. The electrophotographic image forming apparatus according to claim 7, wherein said control portion executes the mode when a slope of potential from a light portion potential to a dark portion potential of the predetermined electrophotographic image is judged as being gentler than a predetermined slope.

12. The electrophotographic image forming apparatus according to claim 11, wherein said control portion controls a rubbing time of said electrophotographic photosensitive member with said rubbing member depending on the output of said potential sensor.

13. The electrophotographic image forming apparatus according to claim 12, wherein said rubbing member includes a blade for removing toner deposited on said electrophotographic photosensitive member.

14. The electrophotographic image forming apparatus according to claim 5, further comprising a control portion for controlling said image forming device so as to form a predetermined electrophotographic image on said electrophotographic photosensitive member and determining whether or not a mode in which said electrophotographic photosensitive member is refreshed is to be executed on the basis of an output of said potential sensor.

15. The electrophotographic image forming apparatus according to claim 14, further comprising a rubbing member for rubbing said electrophotographic photosensitive member, wherein in the mode, said electrophotographic photosensitive member is rubbed with said rubbing member so as to be refreshed.

16. The electrophotographic image forming apparatus according to claim 15, wherein said control portion controls a rubbing time of said electrophotographic photosensitive member with said rubbing member depending on the output of said potential sensor.

17. The electrophotographic image forming apparatus according to claim 5, wherein said curved portion is contactable to said electrophotographic photosensitive member at a contact pressure of 0.01 mg/mm or more and 10 g/mm or less.

18. The electrophotographic image forming apparatus according to claim 5, wherein said potential sensor is provided so as to be inclined toward a downstream side of said electrophotographic photosensitive member with respect to a rotational direction of said electrophotographic photosensitive member.

19. The electrophotographic image forming apparatus according to claim 5, further comprising a charger for electrically charging said electrophotographic photosensitive member and comprising an exposure device for exposing said electrophotographic photosensitive member electrically charged by said charger to light.

* * * * *